US010464320B2

(12) United States Patent
Watanabe et al.

(10) Patent No.: US 10,464,320 B2
(45) **Date of Patent: *Nov. 5, 2019**

(54) LIQUID EJECTING HEAD, LIQUID EJECTING APPARATUS, AND CONTROL METHOD FOR LIQUID EJECTING APPARATUS

(71) Applicant: SEIKO EPSON CORPORATION, Tokyo (JP)

(72) Inventors: Shunsuke Watanabe, Matsumoto (JP); Fumiya Takino, Shiojiri (JP); Shingo Tomimatsu, Matsumoto (JP); Hiroshige Owaki, Okaya (JP); Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/428,025

(22) Filed: Feb. 8, 2017

(65) Prior Publication Data

US 2017/0225456 A1 Aug. 10, 2017

(30) Foreign Application Priority Data

Feb. 10, 2016 (JP) ..... 2016-023389

(51) Int. Cl.

| | |
|---|---|
| ***B41J 2/055*** | (2006.01) |
| ***B41J 2/14*** | (2006.01) |
| ***B41J 2/165*** | (2006.01) |

(52) U.S. Cl.

CPC ..... *B41J 2/055* (2013.01); *B41J 2/14233* (2013.01); *B41J 2/16508* (2013.01); *B41J 2/16532* (2013.01); *B41J 2002/14419* (2013.01); *B41J 2002/16594* (2013.01)

(58) Field of Classification Search

CPC .... B41J 2/055; B41J 2/14233; B41J 2/16532; B41J 2/16508; B41J 2002/16594; B41J 2002/14419

See application file for complete search history.

(56) References Cited

U.S. PATENT DOCUMENTS

| | | | | |
|---|---|---|---|---|
| 9,889,648 | B2 * | 2/2018 | Ishida | B41J 2/17596 |
| 2004/0183876 | A1 | 9/2004 | Mizuno et al. | |
| 2007/0222829 | A1 | 9/2007 | Stathem | |
| 2009/0073241 | A1 | 3/2009 | Sim et al. | |
| 2011/0193914 | A1 | 8/2011 | Yamada et al. | |
| 2013/0076810 | A1 | 3/2013 | Shibata | |
| 2015/0042719 | A1 | 2/2015 | Fukuzawa et al. | |

(Continued)

FOREIGN PATENT DOCUMENTS

| | | |
|---|---|---|
| EP | 2574471 | 4/2013 |
| JP | 2004-237502 A | 8/2004 |
| JP | 2009-073176 A | 4/2009 |

(Continued)

*Primary Examiner* — Henok D Legesse
(74) *Attorney, Agent, or Firm* — Workman Nydegger

(57) ABSTRACT

A liquid ejecting head includes a pressure chamber that communicates with a nozzle which ejects liquid, a liquid chamber that communicates with the pressure chamber, a flexible compliance member that defines a portion of the liquid chamber, and a pressure adjusting mechanism that adjusts a supply pressure of liquid supplied to the liquid chamber. The pressure adjusting mechanism can adjust displacement of the compliance member.

16 Claims, 10 Drawing Sheets

(56) References Cited

U.S. PATENT DOCUMENTS

2015/0174897 A1 6/2015 Arimoto

FOREIGN PATENT DOCUMENTS

| | | | |
|---|---|---|---|
| JP | 2011-161827 | A | 8/2011 |
| JP | 2011-173361 | A | 9/2011 |
| JP | 2011-189636 | A | 9/2011 |
| JP | 2013-071359 | | 4/2013 |
| JP | 2013-184336 | | 9/2013 |
| JP | 2014-024347 | A | 2/2014 |
| JP | 2015-057315 | | 3/2015 |

* cited by examiner

LIQUID EJECTING HEAD, LIQUID EJECTING APPARATUS, AND CONTROL METHOD FOR LIQUID EJECTING APPARATUS

The entire disclosure of Japanese Patent Application No: 2016-023389, filed Feb. 10, 2016 is expressly incorporated by reference herein in its entirety.

BACKGROUND

1. Technical Field

The present invention relates to a liquid ejecting head such as an ink jet recording head, a liquid ejecting apparatus including the liquid ejecting head, and a control method for a liquid ejecting apparatus and particularly relates to a liquid ejecting head and a liquid ejecting apparatus including a compliance member for suppressing fluctuations in pressure in a liquid flow path, and a control method for the liquid ejecting apparatus.

2. Related Art

A liquid ejecting apparatus is an apparatus that includes a liquid ejecting head and ejects (discharges) various kinds of liquid from the liquid ejecting head. As such a liquid ejecting apparatus, there is, for example, an image recording apparatus such as an ink jet printer and an ink jet plotter. Recently, by taking advantage of the feature that a very small amount of liquid can be accurately deposited at a predetermined position, the liquid ejecting apparatus has been applied to various manufacturing apparatuses. For example, the liquid ejecting apparatus has been applied to a display manufacturing apparatus for manufacturing a color filter of a liquid crystal display or the like, an electrode forming apparatus for forming an electrode of an organic electro luminescence (EL) display, a field emission display (FED), or the like, and a chip manufacturing apparatus for manufacturing a bio chip (a biochemical element). A recording head for an image recording apparatus ejects a liquid ink, and a coloring material ejecting head for a display manufacturing apparatus ejects coloring material solutions of R (red), G (green), and B (blue). In addition, an electrode material ejecting head for an electrode forming apparatus ejects an electrode material in a liquid state, and a bioorganic material ejecting head for a chip manufacturing apparatus ejects a bioorganic material solution.

As such a liquid ejecting head, there is a liquid ejecting head that includes a nozzle plate provided with a plurality of nozzles, a substrate in which a plurality of pressure chambers respectively communicating with the nozzles are formed, a substrate in which a liquid chamber (also called a reservoir or a manifold) for introducing the same liquid to each pressure chamber is formed, a driving element such as a piezoelectric element or the like that causes a fluctuation in liquid pressure in the pressure chamber, and a like (for example, refer to JP-A-2013-184336). In a liquid ejecting head having such a configuration, there is provided a compliance portion which evens out fluctuations in liquid pressure in the liquid chamber. In the configuration described in JP-A-2013-184336, a portion of the liquid chamber is sealed by a flexible compliance member (compliance sheet), and the compliance member deforms according to a fluctuation in pressure in the liquid chamber to even out the fluctuation in liquid pressure in the liquid chamber. As the compliance member, a resin sheet, a thin flexible stainless sheet, or the like is used.

Meanwhile, in the liquid ejecting head in the related art, the pressure in a liquid flow path including the liquid chamber and the pressure chamber is adjusted to a pressure lower than the atmospheric pressure (for example, by a reduction of 1 kPa) by using the atmospheric pressure (0 kPa) as a reference (the same applies hereinafter) so that the position of a surface (meniscus) of a liquid in a nozzle before the start of a liquid ejecting operation becomes slightly closer to the pressure chamber than to an opening of the nozzle from which the liquid is ejected. For this reason, the compliance member is bent to protrude toward the liquid chamber side in an initial state before the liquid ejecting operation is performed. When the liquid ejecting operation in the liquid ejecting head is performed in the initial state, the pressure in the liquid chamber is decreased to at most several negative tens of kilopascals in some cases. According to the configuration in the related art, since the compliance member is bent toward the liquid chamber side in the initial state, the displacement magnitude of the compliance member becomes insufficient and it is not possible to sufficiently cope with a large fluctuation in pressure in some cases. As a result of this, there is a problem that the image quality of a recorded image or the like is decreased due to variation in ejecting properties such as the weight or the discharge speed of a liquid droplet ejected from each nozzle. In addition, in a configuration in which the dimensions of the compliance member are increased or a compliance member is separately added in order to compensate for a shortage in the displacement magnitude of the compliance member, there is a problem that the size of the liquid ejecting head increases.

SUMMARY

An advantage of some aspects of the invention is to provide a liquid ejecting head, a liquid ejecting apparatus, and a control method for a liquid ejecting apparatus with which it is possible to secure a large displacement magnitude of a compliance member with respect to a pressure change in a liquid chamber.

According to an aspect of the invention, there is provided a liquid ejecting head including a pressure chamber that communicates with a nozzle which ejects liquid, a liquid chamber that communicates with the pressure chamber, a flexible compliance member that defines a portion of the liquid chamber, and a pressure adjusting mechanism that adjusts a supply pressure of liquid supplied to the liquid chamber, in which the pressure adjusting mechanism can adjust displacement of the compliance member.

In addition, according to another aspect of the invention, there is provided a liquid ejecting head including a pressure chamber that communicates with a nozzle which ejects liquid, a liquid chamber that communicates with the pressure chamber, and a flexible compliance member that defines a portion of the liquid chamber, in which a compliance space that allows displacement of the compliance member is provided at a position opposite to the liquid chamber with the compliance member interposed therebetween, and a pressure adjusting mechanism that adjusts pressure in the compliance space is connected to the compliance space.

With the liquid ejecting head according to the aspects of the invention, it is possible to adjust displacement of the compliance member by using the pressure adjusting mechanism. Therefore, it is possible to secure a large displacement of the compliance member with respect to a pressure change in the liquid chamber. As a result, a fluctuation in pressure in the liquid chamber is more reliably suppressed, and variations in the ejecting properties of each nozzle are decreased. In addition, since it is not necessary to increase the compliance member or to separately add a compliance member, it is possible to cope with miniaturization of the liquid ejecting head.

According to still another aspect of the invention, there is provided a liquid ejecting apparatus including a liquid ejecting head including a pressure chamber that communicates with a nozzle which ejects liquid, a liquid chamber that communicates with the pressure chamber, and a flexible compliance member that defines a portion of the liquid chamber, and a pressure adjusting mechanism that adjusts a supply pressure of liquid supplied to the liquid chamber, in which the pressure adjusting mechanism can adjust displacement of the compliance member.

With the liquid ejecting apparatus according to the aspect of the invention, it is possible to adjust displacement of the compliance member by using the pressure adjusting mechanism. Therefore, it is possible to secure a large displacement magnitude of the compliance member with respect to a pressure change in the liquid chamber. As a result, a fluctuation in pressure in the liquid chamber is more reliably suppressed, and variations in ejecting properties of each nozzle are decreased.

In the liquid ejecting apparatus, a liquid storage container that stores liquid may be provided on an upstream side of the pressure adjusting mechanism in a liquid supply path, and the liquid in the liquid storage container may be sent to the liquid ejecting head side by pressure that is generated by a pressurization mechanism.

According to the configuration, it is possible to adjust displacement of the compliance member by using the pressure generated by the pressurization mechanism that sends liquid in the liquid storage container to the liquid ejecting head side. Therefore, it is not necessary to separately provide a pressurization mechanism, and thus it is possible to simplify a configuration for adjusting displacement of the compliance member.

In the liquid ejecting apparatus, the pressurization mechanism may be a pump.

In addition, in the liquid ejecting apparatus, the pressurization mechanism may be a hydraulic head adjustment mechanism which adjusts the hydraulic head of a meniscus in the nozzle by adjusting relative positions of the liquid ejecting head and the liquid storage container in a vertical direction.

Furthermore, in the liquid ejecting apparatus, the pressure adjusting mechanism preferably includes a valve that adjusts a supply pressure of liquid by opening and closing a liquid supply path, a storage hollow space that is provided on a downstream side of the valve and stores liquid, a flexible pressure receiving member that defines a portion of the storage hollow space, and a pressing mechanism that can open the valve by pressing the pressure receiving member toward the storage hollow space side.

According to the configuration, it is possible to more accurately adjust displacement of the compliance member at an arbitrary time by opening the valve with the pressing mechanism pressing the pressure receiving member toward the storage hollow space side.

According to still another aspect of the invention, there is provided a liquid ejecting apparatus including a pressure chamber that communicates with a nozzle which ejects liquid, a liquid chamber that communicates with the pressure chamber, and a flexible compliance member that defines a portion of the liquid chamber, in which a compliance space that allows displacement of the compliance member is provided at a position opposite to the liquid chamber with the compliance member interposed therebetween, and a pressure adjusting mechanism that adjusts pressure in the compliance space is connected to the compliance space.

With the liquid ejecting apparatus according to the aspect of the invention, it is possible to adjust displacement of the compliance member by using the pressure adjusting mechanism. Therefore, it is possible to secure a large displacement magnitude of the compliance member with respect to a pressure change in the liquid chamber. As a result of this, a fluctuation in pressure in the liquid chamber is more reliably suppressed and variation in ejecting properties of each nozzle communicating with the liquid chamber is decreased.

In the liquid ejecting apparatus, a pressure adjustment path may be provided between the compliance space and the pressure adjusting mechanism, the pressure adjustment path may communicate with the atmosphere via an opening portion which is provided on a nozzle surface including the nozzle of a liquid ejecting head and through which the nozzle is exposed, and the pressure adjusting mechanism may be connected to the compliance space through the opening portion.

In addition, in the liquid ejecting apparatus, the pressure adjustment path preferably includes a check valve that allows air to flow to the outside from the compliance space side and prevents air from flowing to the compliance space side from the outside.

According to the configuration, the pressure in the compliance space is maintained at a low pressure by the check valve and thus it is possible to attenuate the pressure change in the liquid chamber during a recording operation for a longer time. In addition, it is possible to decrease the frequency of displacement adjustment of the compliance member and thus it is possible to reduce the turnaround time of the liquid ejecting apparatus.

In addition, in the liquid ejecting apparatus, the pressure adjusting mechanism is preferably connected to a sealing member that can seal the nozzle surface with the opening portion being covered by the sealing member.

According to the configuration, it is possible to adjust displacement of the compliance member by using the pressure adjusting mechanism that performs a maintenance operation of sealing the nozzle surface by using the sealing member and discharging liquid or the like from the nozzle exposed through the opening portion. Therefore, it is not necessary to separately provide a configuration for adjusting displacement of the compliance member. In addition, it is possible to adjust displacement of the compliance member at the same time as execution of the maintenance operation, and thus it is possible to reduce the turnaround time of the liquid ejecting apparatus.

According to still another aspect of the invention, there is provided a control method for a liquid ejecting apparatus which includes a liquid ejecting head including a pressure chamber that communicates with a nozzle which ejects liquid, a liquid chamber that communicates with the pressure chamber, and a flexible compliance member that defines a portion of the liquid chamber, and a pressure adjusting mechanism that adjusts a supply pressure of liquid supplied to the liquid chamber, the control method including performing displacement adjustment of the compliance member by using the pressure adjusting mechanism in a non-recording region of a recording medium which is on the outside of a recording region in which recording is performed.

With the control method according to the aspect of the invention, it is possible to adjust displacement of the compliance member by using the pressure adjusting mechanism in the non-recording region of the recording medium which is on the outside of the recording region in which recording is performed. Therefore, it is possible to secure a large displacement magnitude of the compliance member with respect to a pressure change in the liquid chamber while preventing adverse effects on the recording operation which are caused by a fluctuation in pressure in the liquid chamber accompanied by the displacement adjustment of the compliance member. As a result of this, a fluctuation in pressure in the liquid chamber is more reliably suppressed and variation in ejecting properties of each nozzle communicating with the liquid chamber is decreased.

In the control method, the displacement adjustment of the compliance member may be performed while a movement direction of the liquid ejecting head is being reversed in the non-recording region during a recording operation in which liquid is ejected from the nozzle with the liquid ejecting head being moved relative to the recording medium.

In this case, the displacement adjustment of the compliance member is performed each time the movement direction of the liquid ejecting head is reversed in the non-recording region, and thus variation in ejecting properties of each nozzle in a series of recording operations is more reliably decreased.

In addition, in the control method, the displacement adjustment of the compliance member may be performed while the nozzle of a line type liquid ejecting head is facing the non-recording region.

According to the method, even in a case where a line type liquid ejecting head is used, the displacement adjustment of the compliance member is performed each time the nozzle of the liquid ejecting head faces the non-recording region, and thus variation in ejecting properties of each nozzle in a series of recording operations is further decreased.

In addition, according to still another aspect of the invention, there is provided a control method for a liquid ejecting apparatus which includes a liquid ejecting head including a pressure chamber that communicates with a nozzle which ejects liquid, a liquid chamber that communicates with the pressure chamber, and a flexible compliance member that defines a portion of the liquid chamber, a pressure adjusting mechanism that adjusts a supply pressure of liquid supplied to the liquid chamber, and a compliance space that is provided at a position opposite to the liquid chamber with the compliance member interposed therebetween and in which a pressure adjustment path that is provided between the compliance space and the pressure adjusting mechanism communicates with the atmosphere via an opening portion which is provided on a nozzle surface including the nozzle of the liquid ejecting head and through which the nozzle is exposed and the pressure adjusting mechanism is a suctioning mechanism that suctions liquid from the nozzle through a sealing member that seals the nozzle surface, the control method including adjusting displacement of the compliance member by sealing the nozzle surface by using the sealing member with the opening portion being covered by the sealing member and suctioning liquid by using the suctioning mechanism.

According to the control method, it is possible to adjust displacement of the compliance member by using the suctioning mechanism (pressure adjusting mechanism) that performs a maintenance operation of sealing the nozzle surface by using the sealing member and discharging liquid or the like from the nozzle exposed through the opening portion. Therefore, it is possible to secure a large displacement magnitude of the compliance member with respect to a pressure change in the liquid chamber. As a result of this, a fluctuation in pressure in the liquid chamber is more reliably suppressed and variation in ejecting properties of each nozzle communicating with the liquid chamber is decreased. In addition, it is possible to adjust displacement of the compliance member at the same time as execution of the maintenance operation, and thus it is possible to reduce the turnaround time of the liquid ejecting apparatus.

According to still another aspect of the invention, there is provided a control method for a liquid ejecting apparatus which includes a liquid ejecting head including a pressure chamber that communicates with a nozzle which ejects liquid, a liquid chamber that communicates with the pressure chamber, and a flexible compliance member that defines a portion of the liquid chamber, and a pressure adjusting mechanism that adjusts a supply pressure of liquid supplied to the liquid chamber, the control method including causing the pressure adjusting mechanism to adjust displacement of the compliance member according to the amount of liquid scheduled to be ejected in a recording operation in which liquid is ejected with respect to a recording medium from the nozzle.

According to the control method, the pressure adjusting mechanism adjusts displacement of the compliance member according to the amount of liquid scheduled to be ejected by the liquid ejecting head, and thus the compliance member can sufficiently cope with a sharp pressure change and to attenuate the pressure change. As a result of this, a fluctuation in pressure in the liquid chamber is more reliably suppressed and variation in ejecting properties of each nozzle communicating with the liquid chamber is more reliably decreased.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In the embodiments described below, various restrictions are made as preferred specific examples of the present invention, but the scope of the present invention is not particularly limited to the embodiments if there is no particular description to limit the invention below. In addition, in the following description, an ink jet printer (hereinafter, a printer) 1 in which an ink jet recording head (hereinafter, a recording head) 10 that is a kind of a liquid ejecting head is mounted will be used as an example of a liquid ejecting apparatus of the invention.

Figure 1:
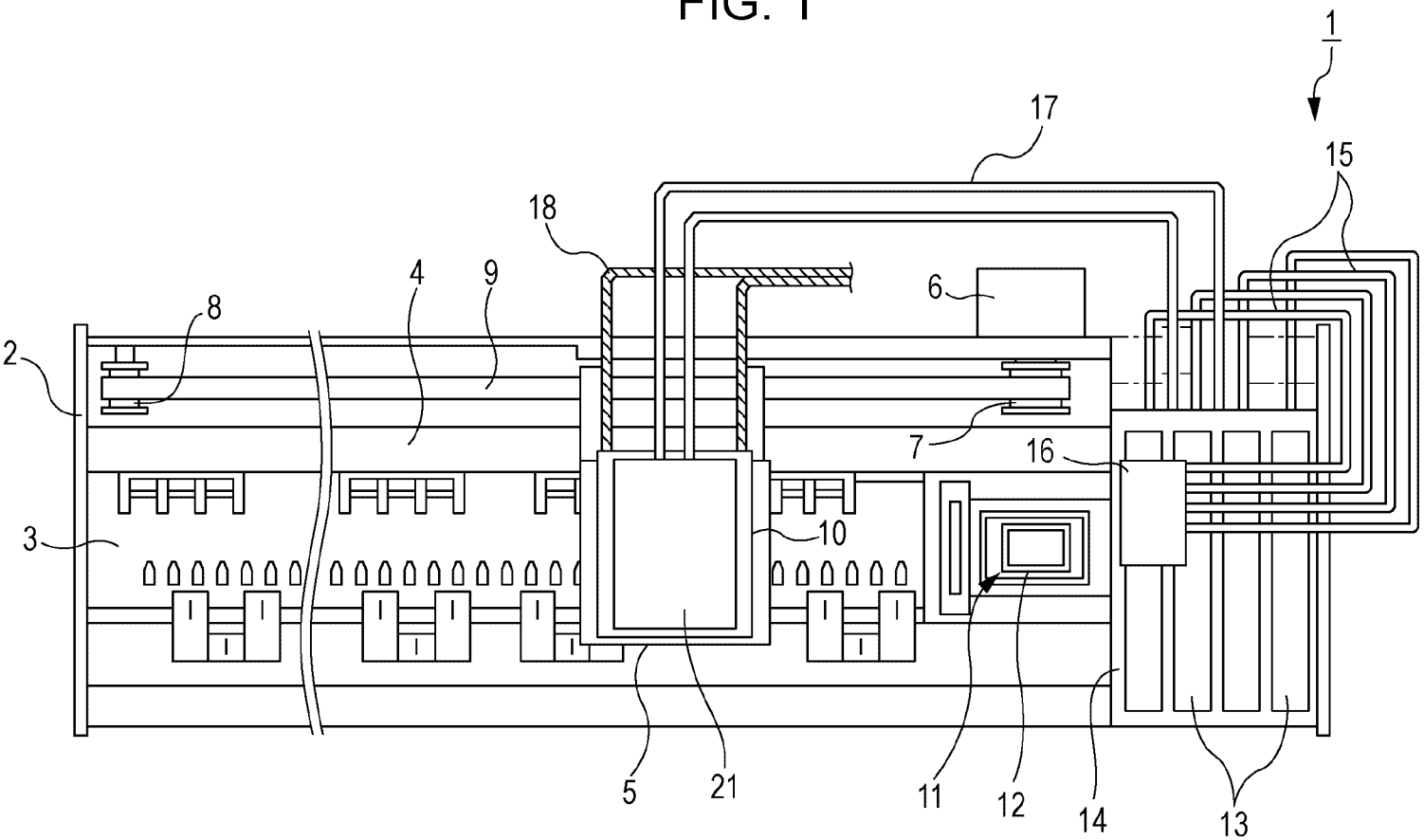
FIG. 1 is a plan view illustrating a configuration of a liquid ejecting apparatus.

FIG. 1 is a plan view illustrating a configuration of an ink jet recording apparatus (hereinafter, referred to as a printer). A printer 1 according to an embodiment is an apparatus which records an image, text, or the like by ejecting liquid ink (a kind of liquid in the invention) onto a surface of a recording medium (deposition target of liquid) (not shown) such as a recording paper sheet, fabric, a resin film, or the like from a recording head 10. The printer 1 includes a frame 2 and a platen 3 provided in the frame 2, and a recording medium is transported onto the platen 3 by a transporting mechanism 81 (refer to FIG. 7). In addition, in the frame 2, a guide rod 4 is suspended parallel to the platen 3, and the guide rod 4 slidably supports a carriage 5 on which the recording head 10 is accommodated. The carriage 5 is configured to reciprocate along the guide rod 4 in a main scanning direction which is orthogonal to a paper feeding direction by using a carriage moving mechanism 80 (refer to FIG. 7). The carriage moving mechanism 80 includes a pulse motor 6, a driving pulley 7 that rotates when the pulse motor 6 is driven, an idler pulley 8 that is provided at a position opposite to the driving pulley 7 in the frame 2, and a timing belt 9 that is suspended between the driving pulley 7 and the idler pulley 8. The printer 1 according to the embodiment performs a recording operation (liquid ejecting operation) by ejecting ink from nozzles 30 (refer to FIG. 2) of the recording head 10 while causing the carriage to reciprocate relative to the recording medium.

One side of the frame 2 is provided with a cartridge holder 14 on which ink cartridges 13 (a kind of a liquid storage container in the invention) are detachably mounted. The ink cartridges 13 are connected to an air pump 16 through air tubes 15, and air from the air pump 16 (a kind of a pressurization mechanism and a pump in the invention) is supplied to each ink cartridge 13. When an ink pack 13' (refer to FIG. 6) provided in the ink cartridge 13 is pressurized by the pressurized air, ink in the ink pack 13' is supplied (is pressure-fed) to the recording head 10 side through an ink supply tube 17. The ink fed from the ink cartridge 13 through the ink supply tube 17 is, first, introduced into a pressure adjusting valve mechanism 21 (which is an example of a pressure adjusting mechanism in the invention and is also called a self-sealing valve since it opens and closes a pressure adjusting valve 57 (refer to FIG. 6) according to a change in inner pressure thereof) mounted on the carriage 5. The ink introduced into the pressure adjusting valve mechanism 21 is supplied to an ink flow path in the recording head 10 through a filter 55 (which will be described later) with the supply pressure thereof being adjusted in a pressure adjusting unit 58. Note that, the example of the liquid storage container is not limited to the above-described one, and liquid storage containers with various configurations such as a cartridge-type liquid storage container, a pack-type liquid storage container, a tank-type liquid storage container, and the like may be used.

The ink supply tube 17 is, for example, a flexible hollow member made of synthetic resin, and ink flow paths which respectively correspond to the ink cartridges 13 are formed in the ink supply tube 17. In addition, between the main body of the printer 1 and the recording head 10, a flexible flat cable (FFC) 18 which transfers a driving signal or the like from a controller (not shown) on the main body side of the printer 1 to the recording head 10 is wired.

At a home position provided on one side (the cartridge holder 14 side) of a moving range of the recording head 10 in the frame 2, a capping mechanism 11 (a kind of a suctioning mechanism in the invention), which includes a cap 12 (a kind of a sealing member in the invention) sealing a nozzle surface of the recording head 10, is provided. The capping mechanism 11 prevents ink solvent from evaporating from the nozzles 30 with the cap 12 sealing the nozzle surface (which is a surface provided with the nozzles 30 and is a bottom surface of the recording head 10 including a nozzle plate 24 and a fixation plate 23) of the recording head 10 which is in a stand-by state at the home position. In addition, the capping mechanism 11 can perform a cleaning operation (maintenance operation) of achieving the negative pressure in a sealing hollow space by using a suction pump 95 (refer to FIG. 11) with the nozzle surface of the recording head 10 being sealed and forcibly suctioning ink or air bubbles from the nozzle 30.

Next, a configuration of the recording head 10 according to the embodiment will be described.

Figure 2:
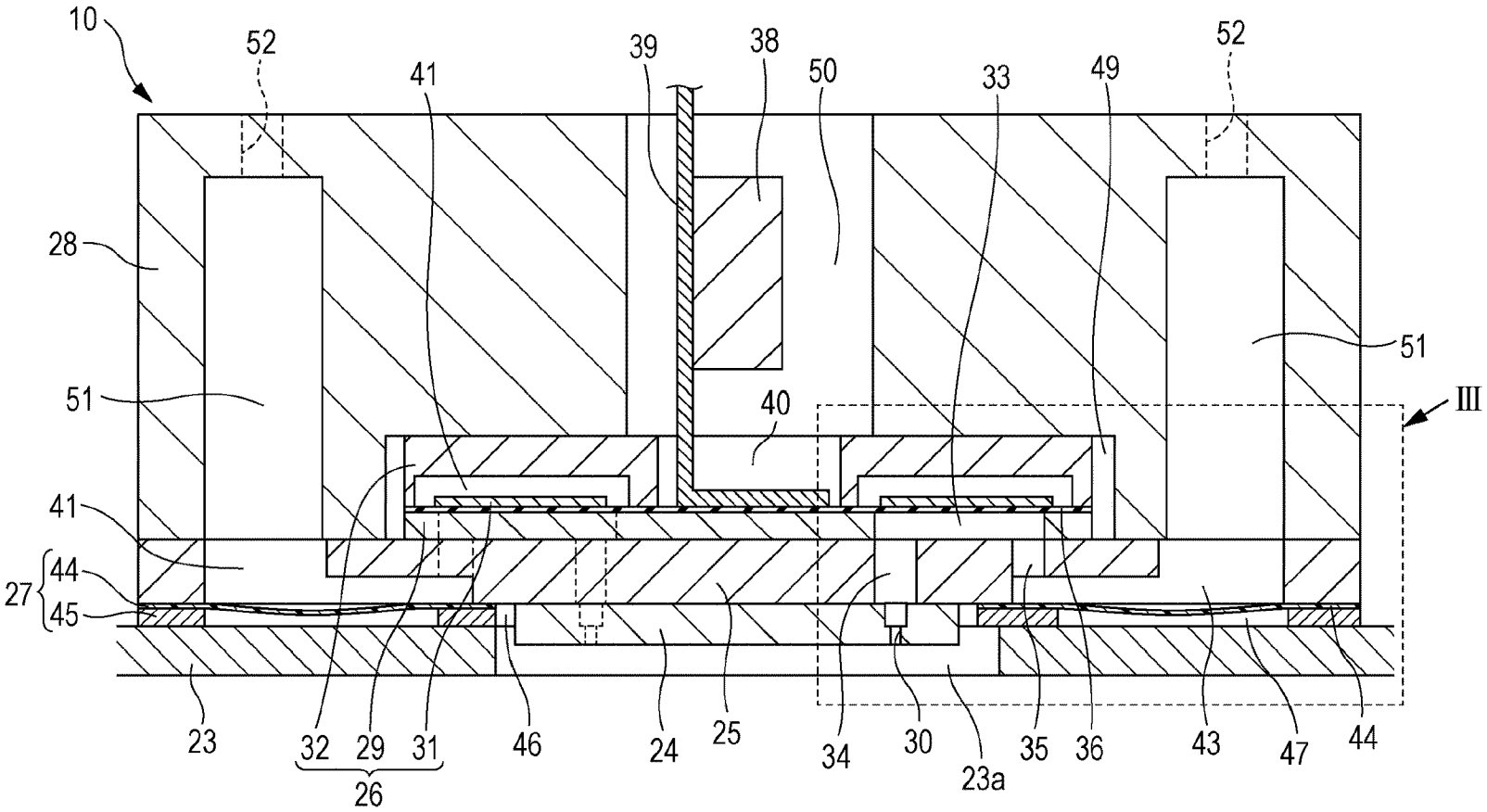
FIG. 2 is a sectional view of a liquid ejecting head.
Figure 3:
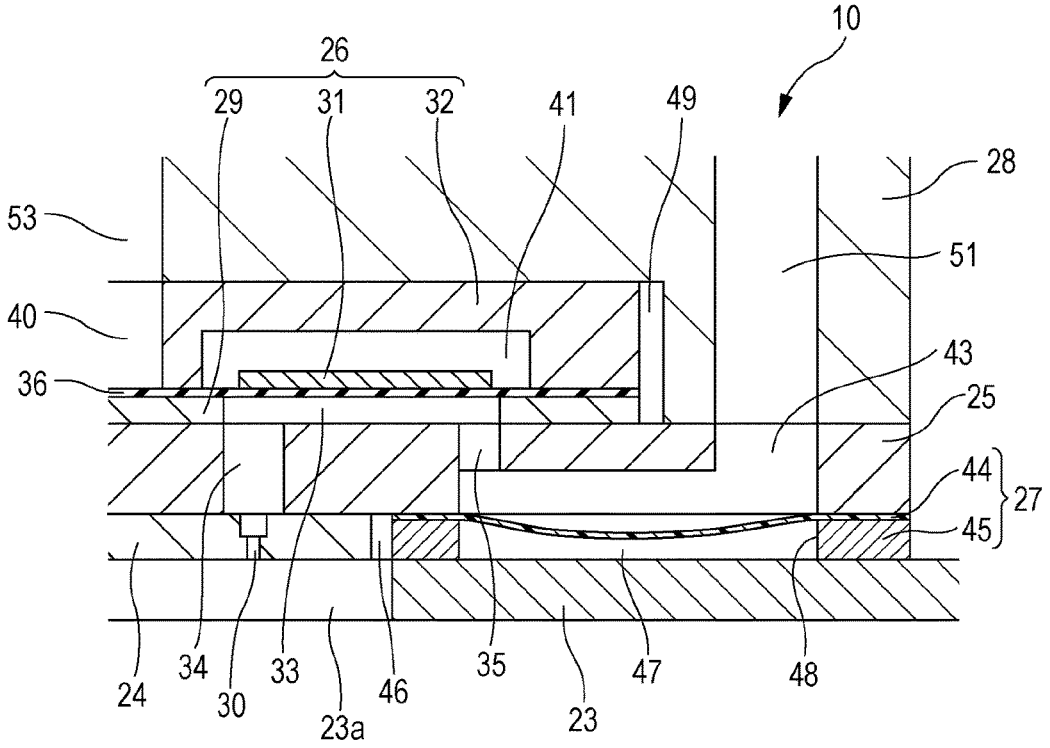
FIG. 3 is an enlarged view of region III in FIG. 2.
Figure 4:
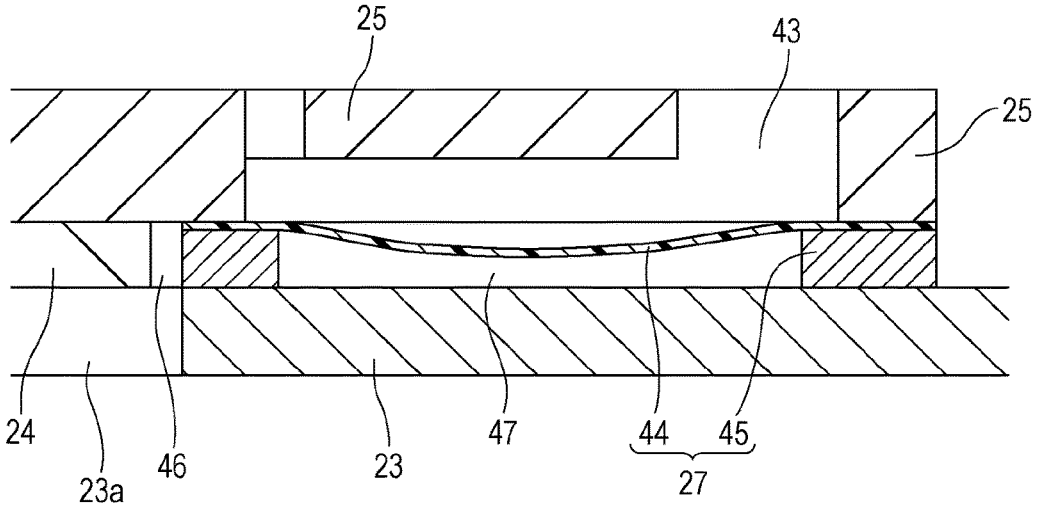
FIG. 4 is an enlarged view of a compliance member.

FIG. 2 is a sectional view of the recording head 10, and FIG. 3 is an enlarged view of region III in FIG. 2. In addition, FIG. 4 is an enlarged view of a compliance member. The recording head 10 according to the embodiment is formed by preparing a unit in which a plurality of components such as the fixation plate 23, the nozzle plate 24, a communication plate 25, an actuator substrate 26, a compliance substrate 27, and a case 28 are stacked and bonded to each other by an adhesive agent or the like and by attaching the unit to a holder 22 (refer to FIG. 6). Note that, hereinafter, a direction in which the components of the recording head 10 are stacked is appropriately referred to as a vertical direction.

The actuator substrate 26 according to the embodiment includes a pressure chamber formation substrate 29 in which pressure chambers 33 communicating with the nozzles 30 formed on the nozzle plate 24 are formed, piezoelectric elements 31 as driving elements causing a fluctuation in ink pressure in each pressure chamber 33, and a protection substrate 32 that protects the pressure chamber formation substrate 29 and the piezoelectric elements 31. The pressure chamber formation substrate 29, the piezoelectric elements 31, and the protection substrate 32 are stacked on each other. The substantially central portion of the protection substrate 32 in plan view is provided with a wiring hollow space 40 into which a flexible substrate 39, on which a driver IC 38 is mounted, is inserted. In the wiring hollow space 40, a lead electrode of the piezoelectric element 31 is disposed and a wiring terminal of the flexible substrate 39 is electrically connected to the lead electrode. A terminal of the flexible substrate 39 other than the terminal of the flexible substrate 39 that is connected to the lead electrode of the piezoelectric element 31 is electrically connected to a terminal of a circuit substrate 19 (refer to FIG. 6) provided in the holder 22. A driving signal and the like, which are transferred from a printer controller 76 through the FFC 18, are supplied to the piezoelectric element 31 through the circuit substrate 19 and the flexible substrate 39. Note that, the flexible substrate 39 is not limited to a flexible substrate including the driver IC 38, and a configuration in which the driver IC 38 is separately disposed on a sealing plate 32*b* with a so called interposer interposed therebetween and no driver IC 38 is provided in the flexible substrate 39 may be adopted.

The pressure chamber formation substrate 29 of the actuator substrate 26 is made from a silicon single crystal substrate. In the pressure chamber formation substrate 29, spaces as the pressure chambers 33 are provided in a plurality of rows corresponding to each nozzle 30. The pressure chamber 33 is a hollow space elongated in a direction intersecting a nozzle row (in the embodiment, a direction orthogonal to the nozzle row). An end portion in a longitudinal direction of the pressure chamber 33 communicates with a nozzle communication port 34, and the other end portion of the pressure chamber 33 communicates with an individual communication port 35. In the pressure chamber formation substrate 29 according to the embodiment, two rows of pressure chambers 33 are formed.

On an upper surface (a surface at a position opposite to the communication plate 25) of the pressure chamber formation substrate 29, a vibrating plate 36 is stacked, and the vibrating plate 36 seals an upper opening of the pressure chamber 33. That is, the vibrating plate 36 defines a portion of the pressure chamber 33. The vibrating plate 36 is constituted by, for example, an elastic film made of silicon dioxide ($SiO_2$) which is formed on the upper surface of the pressure chamber formation substrate 29 and an insulating film made of zirconium oxide ($ZrO_2$) which is formed on the elastic film. In addition, the piezoelectric elements 31 are stacked on regions on the vibrating plate 36 which correspond to each pressure chamber 33, respectively.

The piezoelectric element 31 according to the embodiment is a so-called bending mode piezoelectric element. The piezoelectric element 31 is formed by sequentially stacking a lower electrode layer, a piezoelectric layer, and an upper electrode layer (which are not shown) on the vibrating plate 36, for example. The piezoelectric element 31 formed as described above bends in the vertical direction when an electric field in response to a potential difference between both electrodes is applied between the lower electrode layer and the upper electrode layer. In the embodiment, two rows of piezoelectric elements 31 corresponding to the two rows of pressure chambers 33 are formed. Note that, each of the lower electrode layer and the upper electrode layer extends from each of the two rows of piezoelectric elements 31 into the wiring hollow space 40 positioned between the two rows as a lead electrode and is electrically connected to the flexible substrate 39 as described above.

The protection substrate 32 is stacked on the vibrating plate 36 to cover the two rows of piezoelectric elements 31. In the protection substrate 32, long accommodation spaces 41 each of which can accommodate a row of piezoelectric elements 31 are formed. The accommodation space 41 is a recess which is formed to extend up to a middle portion in a height direction of the protection substrate 32 in a direction from a lower surface of the protection substrate 32 (the vibrating plate 36 side) to an upper surface of the protection substrate 32 (the case 28 side). In the protection substrate 32 according to the embodiment, the accommodation spaces 41 are formed on the respective opposite sides of the wiring hollow space 40.

The communication plate 25 which has a larger area than the actuator substrate 26 is bonded to a lower surface of the actuator substrate 26. The communication plate 25 is made from a silicon single crystal substrate as with the pressure chamber formation substrate 29. In the communication plate 25 according to the embodiment, the nozzle communication port 34 through which the pressure chamber 33 and the nozzle 30 communicates with each other, reservoirs 43 provided to be shared by each pressure chamber, and the individual communication port 35 through which the reservoir 43 and the pressure chamber 33 communicates with each other are formed. The reservoir 43 (which corresponds to a liquid chamber in the invention and is also called a manifold) is a hollow space extending along a direction in which the nozzle row extends, and two reservoirs 43 are formed in the communication plate 25 corresponding to the nozzle lows of the nozzle plate 24 respectively. That is, the reservoir 43 is provided for each kind of ink. A plurality of the individual communication ports 35 are formed along the direction in which the nozzle row extends corresponding to each pressure chamber 33. The individual communication port 35 communicates with the other end portion (at a position opposite to the nozzle communication port 34) in the longitudinal direction of the pressure chamber 33.

The nozzle plate 24 in which the plurality of nozzles 30 are formed is bonded to the substantially central portion of a lower surface of the communication plate 25. The nozzle plate 24 according to the embodiment is a plate member smaller than the communication plate 25 and the actuator substrate 26 and is made from a silicon single crystal substrate. The nozzle plate 24 is bonded to a region of the lower surface of the communication plate 25 which is positioned to be separated from openings of the reservoirs 43 and on which the nozzle communication ports 34 open by an adhesive agent or the like with the nozzle communication ports 34 respectively communicating with the plurality of nozzles 30. In the nozzle plate 24 according to the embodiment, total two rows of nozzles each of which is constituted by the plurality of nozzles 30 are formed.

In addition, the compliance substrate 27 provided with a through-opening 46 which has a shape similar to the external shape of the nozzle plate 24 and is formed on the central portion of the compliance substrate 27 is bonded to the lower surface of the communication plate 25 in such a manner that the compliance substrate 27 surrounds the vicinity of the nozzle plate 24. The through-opening 46 of the compliance substrate 27 is configured such that the through-opening 46 communicates with a through-port 23*a* of the fixation plate 23 and the nozzle plate 24 is disposed inside the through-opening 46. The through-opening 46 and the through-port 23*a* communicating with the through-opening 46 correspond to an opening portion in the invention.

The compliance substrate 27 seals the openings of the reservoirs 43 on the lower surface of the communication plate 25 being positioned and bonded to the lower surface of the communication plate 25. As illustrated in FIGS. 3 and 4, the compliance substrate 27 according to the embodiment is configured by bonding a compliance sheet 44 (corresponding to a compliance member in the invention) and a supporting plate 45 that supports the compliance sheet 44 to each other. The compliance sheet 44 of the compliance substrate 27 is bonded to the lower surface of the communication plate 25 with the compliance sheet 44 interposed between the communication plate 25 and the supporting plate 45. The compliance sheet 44 is a flexible thin film made of, for example, synthetic resin material such as polyphenylene sulfide (PPS). The supporting plate 45 is formed of metal material such as stainless steel having a larger stiffness and thickness than the compliance sheet 44. On a region of the supporting plate 45 which faces the reservoir 43, a compliance opening 48, which is obtained by removing a portion of the supporting plate 45 to have a shape similar to that of a lower surface opening of the reservoir 43, is formed. For this reason, the opening of the reservoir 43 on the lower surface side is sealed by the flexible compliance sheet 44 only. In other words, the compliance sheet 44 defines a portion of the reservoir 43.

A portion of a lower surface of the supporting plate 45, which corresponds to the compliance opening 48, is sealed by the fixation plate 23. Therefore, between a flexible region of the compliance sheet 44 and the fixation plate 23 that faces the flexible region, a compliance space 47 is formed. In addition, the flexible region of the compliance sheet 44 in the compliance space 47 is displaced toward the reservoir 43 side or the compliance space 47 side according to a fluctuation in pressure in the ink flow path, particularly, a fluctuation in pressure in the reservoir 43. Accordingly, the thickness of the supporting plate 45 is determined according to the height required for the compliance space 47.

The actuator substrate 26 and the communication plate 25 are fixed to the case 28. The case 28 has the approximately same shape as the communication plate 25 in a plan view, and on a lower surface of the case 28, an accommodation hollow space 49 in which the actuator substrate 26 is accommodated is formed. In addition, the lower surface of the case 28 is sealed by the communication plate 25 with the actuator substrate 26 being accommodated in the accommodation hollow space 49. As illustrated in FIG. 2, the substantially central portion of the case 28 in a plan view is provided with a communication hollow space 50 that communicates with the accommodation hollow space 49. The communication hollow space 50 communicates with the wiring hollow space 40 of the actuator substrate 26 also. The flexible substrate 39 is configured to be inserted into the wiring hollow space 40 through the communication hollow space 50. In addition, in the case 28, on each of the opposite sides of the communication hollow space 50 and the accommodation hollow space 49, a liquid chamber hollow space 51 that communicates with the reservoir 43 of the communication plate 25 is formed. Furthermore, on an upper surface of the case 28, inlet ports 52 which respectively communicate with the liquid chamber hollow spaces 51 are provided. The inlet ports 52 communicate with outlet ports 64 in the pressure adjusting valve mechanism 21 through an introduction flow path 20 (refer to FIG. 6) in a flow path member provided in the holder 22. Therefore, ink fed from the pressure adjusting valve mechanism 21 is introduced into the inlet port 52, the liquid chamber hollow spaces 51, and the reservoir 43 and is supplied to each pressure chamber 33 from the reservoir 43 through the individual communication port 35.

The fixation plate 23 is, for example, a plate member made of metal such as stainless steel. On the fixation plate 23 according to the embodiment, at a position corresponding to the nozzle plate 24, the through-port 23*a* which has a shape similar to the external shape of the nozzle plate 24 is formed to expose the nozzles 30 formed on the nozzle plate 24 while penetrating the fixation plate 23 in a thickness direction of the fixation plate 23. As described above, the through-port 23*a* communicates with the through-opening 46 of the compliance substrate 27. In the embodiment, the nozzle surface in the invention is constituted by a lower surface of the fixation plate 23 and a portion of the nozzle plate 24 exposed through the through-port 23*a*. The fixation plate 23 is bonded to the holder 22 (refer to FIG. 6) by an adhesive agent or the like, the holder 22 accommodating the case 28 to which the actuator substrate 26 and the communication plate 25 are fixed.

In addition, in the recording head 10 having the above-described configuration, when the piezoelectric element 31 is driven according to the driving signal from the driver IC 38 in a state where a flow path that extends from the liquid chamber hollow space 51 to the nozzle 30 through the reservoir 43 and the pressure chamber 33 is filled with ink, the pressure of ink in the pressure chamber 33 fluctuates and thus ink is ejected from a predetermined nozzle 30 due to the fluctuation in pressure. In addition, when the compliance sheet 44 is displaced (bent) due to the fluctuation in pressure in the ink flow path (in the reservoir 43) which is accompanied by the recording operation (liquid ejecting operation) of the recording head 10, the fluctuation in pressure is evened out. Therefore, variation in ejecting properties (the amount or the discharge speed of a liquid droplet ejected from the nozzle 30) is suppressed which occurs in a case where, for example, a fluctuation in pressure in the pressure chamber 33, which occurs when ink is ejected from one nozzle 30, is transmitted to the reservoir 43 via the individual communication port 35 and is transmitted to the pressure chamber 33 on the other nozzle 30 side.

Figure 5:
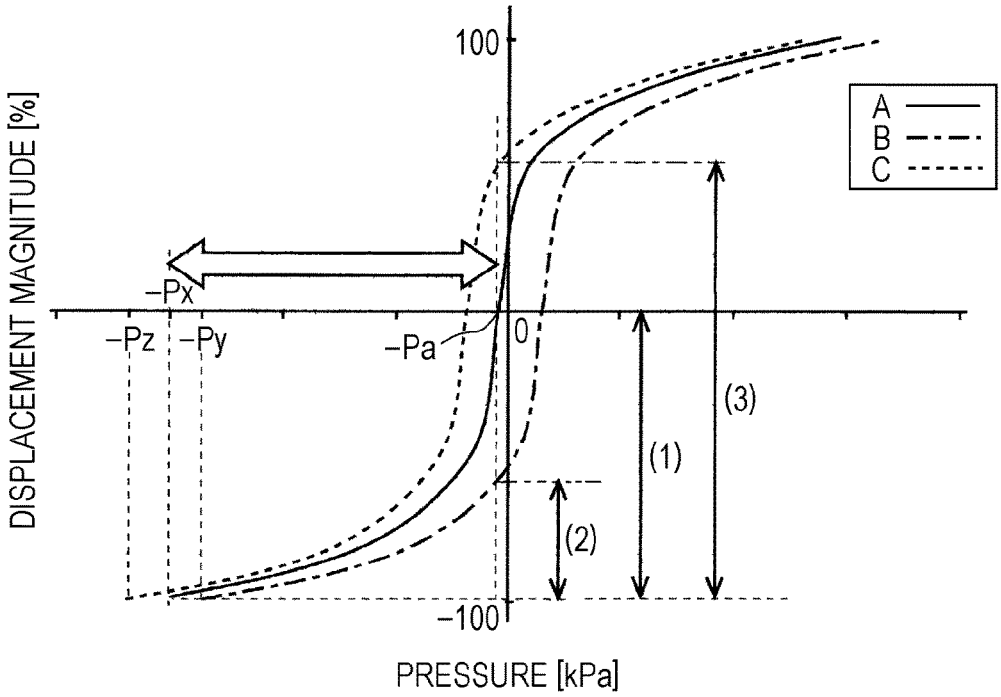
FIG. 5 is a graph illustrating a relationship between the pressure change and the displacement magnitude of the compliance member.

FIG. 5 is a graph illustrating a relationship between the pressure change in the reservoir 43 and the displacement magnitude of the compliance sheet 44. In FIG. 5, the horizontal axis represents the pressure (kPa) (with the atmospheric pressure as a reference) in the reservoir 43 and the vertical axis represents the displacement magnitude (%) of the compliance sheet 44. Regarding the displacement magnitude of the compliance sheet 44, the displacement magnitude is represented as 0% when the compliance sheet 44 is in a state of being flat (a state in which the compliance sheet 44 is substantially parallel to an opening surface of the reservoir 43 which is sealed by the compliance sheet 44), is represented as −100% when the central portion of the compliance sheet 44 is displaced toward the inside of the reservoir 43 at the maximum rate, and is represented as 100% when the central portion of the compliance sheet 44 is displaced toward the outside (the compliance space 47 side), which is opposite to the reservoir 43, at the maximum rate.

Here, when it is assumed that the pressure P in the reservoir 43 changes from an initial value −Pa (kPa) to the maximum value −Px (kPa) (a range represented by an outlined arrow in FIG. 5) during the recording operation performed by the recording head 10 and the compliance sheet 44 is flat (0%) in an initial state (a state where the pressure P is the initial value −Pa (kPa)) immediately before the recording operation is started (a curved line (a solid line) denoted by A in FIG. 5), since the compliance sheet 44 can be displaced up to −100% when the pressure P changes to the maximum value −Px (kPa), in this example, it is possible to cope with a change in pressure P over the above-described range. Here, when a change in volume of the reservoir 43 due to displacement of the compliance sheet 44 is represented by $\Delta V$, a change in pressure in the reservoir 43 is represented by $\Delta P$, the compliance amount C of the compliance sheet 44 is represented by $C=\Delta V/\Delta P$. In the case of A, since the compliance sheet 44 is displaced over a range denoted by (1) (from −100% to 0%), which is a portion of the displaceable range of the compliance sheet 44 (from −100% to 100%), in response to a change in pressure P over the above-described range, it can be said that approximately 50% of the performance of the compliance sheet 44 is used.

Meanwhile, as described above, in the liquid ejecting head in the related art, the compliance sheet is bent to protrude to the reservoir side in the initial state before the recording operation is performed. For example, when it is assumed that the displacement magnitude at this time is −50%, as a curved line (one dot chain line) denoted by B in FIG. 5, the displacement magnitude of the compliance sheet 44 becomes −100% in a state where the pressure P is a value −Py (kPa) which is closer to the initial value Pa than the maximum value −Px (kPa) is, and the compliance sheet 44 cannot be displaced further. In this case, ΔV in the above-described expression becomes smaller than in the case of A, and thus the compliance amount C is also decreased. Therefore, with a configuration in the related art, it is not possible to cope with a change in pressure up to −Px (kPa), and there is a concern that the ink supply pressure from the reservoir 43 to the pressure chamber 33 may be decreased and ejecting properties for liquid ejected from the nozzle may vary. Particularly, such a problem is likely to occur in a case where a larger amount of ink is ejected from a larger number of nozzles 30 at a higher frequency as in so-called solid printing (in a case where the duty is high). With the configuration in the related art, the performance of the compliance sheet 44 is exerted only over a range denoted by (2) which is narrower than (1) (approximately 25% of the performance of the compliance sheet 44), which is not efficient. In view of such circumstances, in the embodiment, the pressure in the reservoir 43 is adjusted by using the pressure adjusting valve mechanism 21 such that the compliance sheet 44 is displaced (bent) toward the outside, which is opposite to the reservoir 43, as illustrated by a curved line (a broken line) denoted by C in FIG. 5 at least for the initial state immediately before the recording operation (liquid ejecting operation) is started and thus it is possible to cope with a wider range of pressure change. For example, in the case of the curved line C, the compliance sheet 44 is displaced over a range denoted by (3) (from −100% to 50%), which is a portion of the displaceable range of the compliance sheet 44, in response to a change in pressure P over the above-described range, it is possible to increase the compliance amount C by increasing ΔV in the above-described expression and it is possible to coper with a larger pressure change. Hereinafter, this point will be described.

Figure 6:
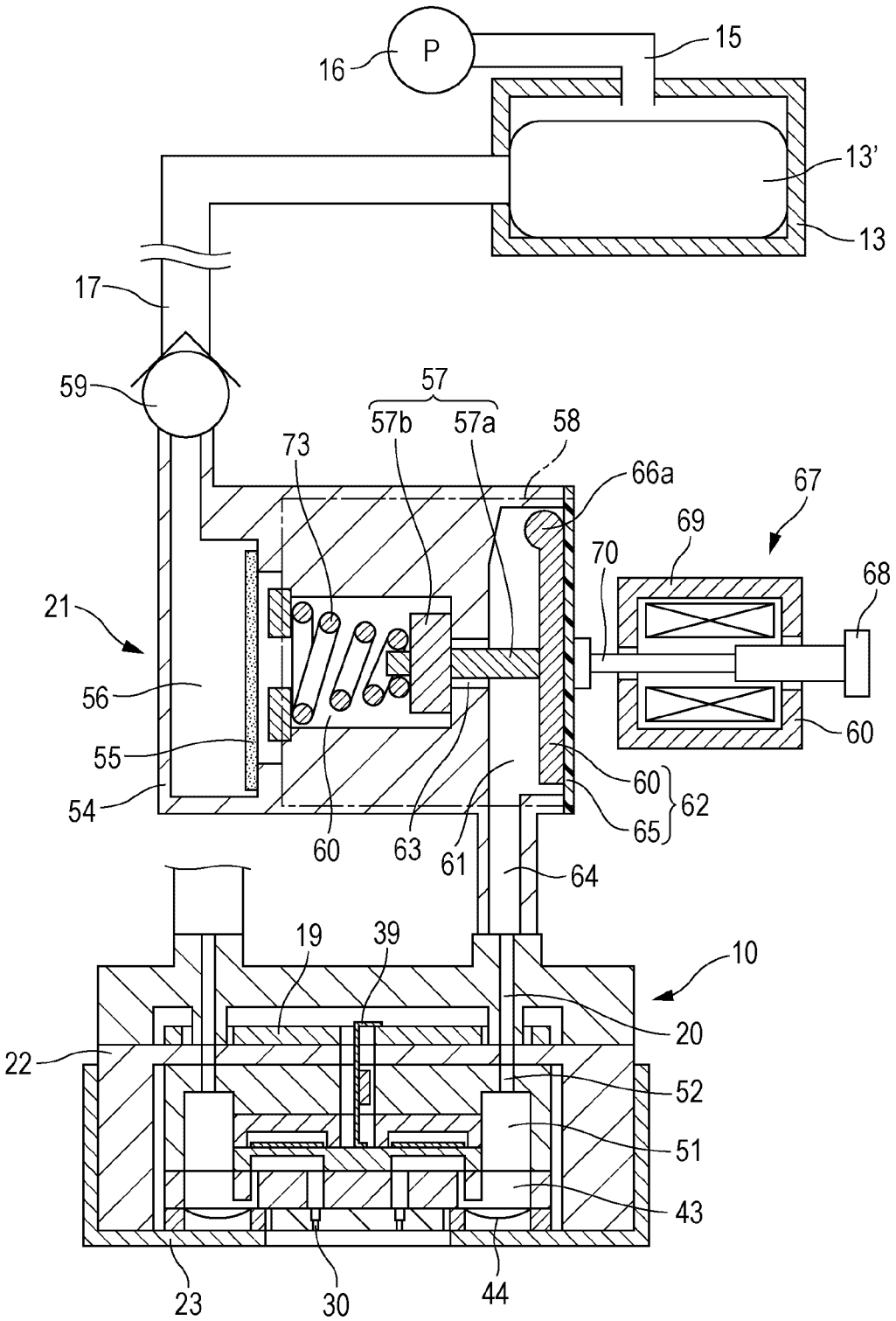
FIG. 6 is a view illustrating a liquid supply path in the liquid ejecting apparatus.

FIG. 6 is a schematic view illustrating a configuration of an ink supply path which extends from the ink cartridge 13 to the recording head 10 through the pressure adjusting valve mechanism 21. Although a configuration corresponding to one nozzle row is disclosed in FIG. 6, the other nozzle rows also have the same configuration. In the embodiment, a flow path, which extends from the ink cartridge 13 to the reservoir 43 of the recording head 10 through the ink supply tube 17 and the pressure adjusting valve mechanism 21, corresponds to a liquid supply path in the invention. The pressure adjusting valve mechanism 21 in the embodiment includes a filter chamber 56 in which the filter 55 is provided and the pressure adjusting unit 58 including the pressure adjusting valve 57 (a kind of a valve in the invention) for opening and closing the ink supply path in a casing 54 made of synthetic resin or the like. Ink fed from the ink cartridge 13 through the ink supply tube 17 flows into a valve accommodation chamber 60 after the ink is introduced into the filter chamber 56 in the pressure adjusting valve mechanism 21 via a check valve 59 and is filtered by the filter 55. The check valve 59 allows ink to flow into the filter chamber 56 from the ink supply tube 17 side and prevents ink from flowing to the ink supply tube 17 side from the filter chamber 56.

The pressure adjusting unit 58 is schematically configured to include the valve accommodation chamber 60 in which the pressure adjusting valve 57 is provided, a pressure adjusting chamber 61 (a kind of a storage hollow space in the invention) which communicates with the valve accommodation chamber 60, and a pressure receiving member 62 which is provided sealing one opening portion of the pressure adjusting chamber 61. The pressure adjusting chamber 61 is a hollow space which extends from one surface (the right surface in FIG. 6) of the casing 54 toward the other surface (the left surface in FIG. 6) side. An inflow port 63 is provided on the substantially central portion of the bottom portion (a partition wall between the pressure adjusting chamber 61 and the valve accommodation chamber 60) of the pressure adjusting chamber 61 and the inflow port 63 communicates with the valve accommodation chamber 60. In addition, the outlet port 64 is provided on the bottom portion of the pressure adjusting chamber 61 which is on the downstream side of the inflow port 63.

The pressure receiving member 62 is constituted by a film member 65 which is elastically deformed toward the inside of the pressure adjusting chamber 61 (toward the other side surface of the casing 54) in accordance with the pressure change in the pressure adjusting chamber 61 and a pressure receiving plate 66 which is provided inside the film member 65 (the pressure adjusting chamber 61 side). The film member 65 is made from, for example, a thin flexible resin film. The film member 65 is adhered or welded to one side surface of the casing 54 so as to seal the opening portion of the recess serving as the pressure adjusting chamber 61 (that is, one opening surface of the pressure adjusting chamber 61). The pressure receiving plate 66 is provided being in a so-called cantilever beam state in which one end portion 66*a* side is supported by the casing 54 in the pressure adjusting chamber 61 and the pressure receiving plate 66 is configured to be rotatable around the one end portion 66*a* in accordance with deformation of the film member 65.

The pressure adjusting valve 57 is configured in such a manner that the state of the pressure adjusting valve 57 can transitions into an opened state in which introduction of ink into the pressure adjusting chamber 61 is allowed and a closed state in which introduction of ink into the pressure adjusting chamber 61 is blocked. The pressure adjusting valve 57 is provided in the valve accommodation chamber 60 being urged toward the closing position side by an urging member 73. The pressure adjusting valve 57 is constituted by a columnar shaft portion 57*a* and a substantially disk-shaped flange portion 57*b* that extends laterally from the middle portion of the shaft portion 57*a*. The distal end portion (on the further distal end side than the flange portion 57*b* is) of the shaft portion 57*a* is formed to have an outer diameter smaller than the inner diameter of the inflow port 63 and is inserted into the pressure adjusting chamber 61 through the inflow port 63. In addition, through a space between the shaft portion 57*a* and the inner circumferential surface of the inflow port 63, ink from the filter chamber 56 side is introduced into the pressure adjusting chamber 61.

The urging member 73 abuts onto the flange portion 57*b* of the pressure adjusting valve 57 to urge the entire pressure adjusting valve 57 to the pressure adjusting chamber 61 side, and maintains the closed state until the pressure in the pressure adjusting chamber 61 is decreased to a predetermined pressure or until receiving a pressing force from a pressing mechanism 67 which will be described later. That is, the pressure adjusting valve 57 is held at the closing position in which the flange portion 57*b* comes in close contact with the edge of an opening of the inflow port 63 unless the pressure adjusting valve 57 receives a stress against the resultant force of the pressure of ink from the filter chamber 56 side and the elastic force of the urging member 73. In addition, in the closing position, the pressure adjusting valve 57 blocks inflow of ink from the valve accommodation chamber 60 side to the pressure adjusting chamber 61 side.

When the pressure adjusting valve 57 is closed and thus the inflow of ink to the pressure adjusting chamber 61 is blocked, the pressure in the filter chamber 56 which is on the upstream side of the pressure adjusting valve 57 becomes larger than the pressure in the pressure adjusting chamber 61 since ink is fed from the ink cartridge 13 due to pressurization performed by the air pump 16. On the other hand, the pressure in the pressure adjusting chamber 61 which is on the downstream side of the pressure adjusting valve 57 is gradually decreased as ink is consumed by the recording head 10, and a potential difference between the pressure adjusting chamber 61 and the outside space beyond the pressure receiving member 62 (the atmosphere) is generated. As a result of this, the film member 65 of the pressure receiving member 62 is elastically deformed toward the inside of the pressure adjusting chamber 61 and the pressure receiving plate 66 is pressed toward the bottom portion side (the pressure adjusting valve 57 side). In accordance with this, the pressure receiving plate 66 presses the distal end portion of the shaft portion 57*a* of the pressure adjusting valve 57 which is in the closing position and moves the pressure adjusting valve 57 in an opening direction (to the filter chamber 56 side) against the resultant force of the pressure of ink from the filter chamber 56 side and the urging force of the urging member 73 acting on the pressure adjusting valve 57. Accordingly, the pressure adjusting valve 57 is displaced to a position (an opening position) in which the flange portion 57*b* is separated from the edge of the opening of the inflow port 63 and the close contact is released (the opened state).

In the opened state, ink is allowed to flow into the pressure adjusting chamber 61 from the valve accommodation chamber 60 side through the inflow port 63. The ink flowing into the pressure adjusting chamber 61 flows into the ink flow path of the recording head 10 through the outlet port 64. When ink flows into the pressure adjusting chamber 61 after the valve is open, the inner pressure of the pressure adjusting chamber 61 is gradually increased. With the increase in inner pressure of the pressure adjusting chamber 61, the pressure receiving member 62 is gradually displaced toward the opening surface side from the bottom portion side (the pressure adjusting valve 57 side) of the pressure adjusting chamber 61. Eventually, the pressure receiving member 62 is displaced up to the closing position due to the urging force of the urging member 73 acting on the pressure adjusting valve 57 and the pressure of ink from the filter chamber 56 side and thus the flange portion 57*b* comes in close contact with the edge of the opening of the inflow port 63 to close the inflow port 63 and block inflow of ink to the pressure adjusting chamber 61.

In the embodiment, on an outer surface of the film member 65, the pressing mechanism 67 is separately provided. The pressing mechanism 67 is a mechanism that presses the pressure receiving member 62 being operated under control of a printer controller 76 (refer to FIG. 7). The pressing mechanism 67 in the embodiment is configured by using, for example, a push solenoid and the pressing mechanism 67 moves a shaft 70 connected to a plunger 68 forward and backward relative to a frame member 69 along an opening/closing direction of the pressure adjusting valve 57 according to ON/OFF control performed by the printer controller 76. The distal end of the shaft 70 abuts onto the pressure receiving member 62 and when the shaft 70 is caused to protrude from the frame member 69, the pressure receiving member 62 can be pressed and displaced toward the pressure adjusting valve 57 side. In addition, the printer controller 76 adjusts displacement (an initial position which will be described) of the compliance sheet 44 by pressing the pressure receiving member 62 by using the pressing mechanism 67.

When the pressing mechanism 67 presses the pressure receiving member 62, the film member 65 of the pressure receiving member 62 is elastically deformed toward the inside of the pressure adjusting chamber 61 and thus ink in the pressure adjusting chamber 61 is pressurized. Although the pressure adjusting valve 57 is open in accordance with this, since the pressure in the filter chamber 56 becomes larger than the pressure in the pressure adjusting chamber 61 as described above and the check valve 59 is provided on the entrance of the filter chamber 56 (between the pressure adjusting valve 57 and the ink supply tube 17) in the embodiment, the pressure in the pressure adjusting chamber 61 which becomes high due to the pressing mechanism 67 pressing the pressure receiving member 62 does not escape to the ink cartridge 13 side. Accordingly, the pressure in the reservoir 43 that communicates with the pressure adjusting chamber 61 is also increased. In accordance with the pressure change, the compliance sheet 44 is displaced toward the outside, which is opposite to the reservoir 43. That is, a state in which the pressure in the compliance space 47, which is at a position opposite to the reservoir 43 with the compliance sheet 44 interposed therebetween, is lower than the pressure in the reservoir 43 is achieved.

Note that, for a time at which the pressure adjusting valve 57 is opened by the pressing mechanism 67, the operation of the air pump 16 may be stopped or the air pump 16 may be operated. In the former case, displacement of the compliance sheet 44 can be adjusted by using the pressure that is generated when the pressing mechanism 67 presses the pressure receiving member 62 as described above. In addition, in the latter case, since the supply pressure from the air pump 16 is added to the pressure that is generated when the pressing mechanism 67 presses the pressure receiving member 62, the displacement adjustment of the compliance sheet 44 is finished more quickly. In this case, the check valve 59 is not necessarily provided. In addition, by adjusting the openness (the movement amount of the pressure adjusting valve 57 toward the filter chamber 56 side and the time for which the pressure adjusting valve 57 is open) of the pressure adjusting valve 57 with the pressing mechanism 67 pressing the pressure receiving member 62, it is possible to arbitrarily adjust the displacement magnitude of the compliance sheet 44. As described above, it is possible to adjust displacement of the compliance sheet 44 using the pressure adjusting valve mechanism 21 that adjusts the ink supply pressure or the supply pressure from the air pump 16, which is a kind of a pressurization mechanism for feeding ink in the ink cartridge 13 to the recording head 10. Therefore, it is not necessary to separately provide a pressurization mechanism (pressure generating source), and it is possible to simplify the configuration for adjusting the displacement of the compliance sheet 44.

The above-described pressure adjusting valve mechanism 21 is provided corresponding to each reservoir 43 (corresponding to each compliance sheet 44). Regarding the pressure adjusting valve mechanism 21, in the embodiment, a configuration in which the pressure adjusting valve mechanism 21 is a separate member from the recording head 10 has been exemplified. However, the present invention is not limited thereto, and a configuration corresponding to the pressure adjusting valve mechanism 21 may be provided in the recording head 10.

Next, the recording operation in the printer 1 will be described.

Figure 7:
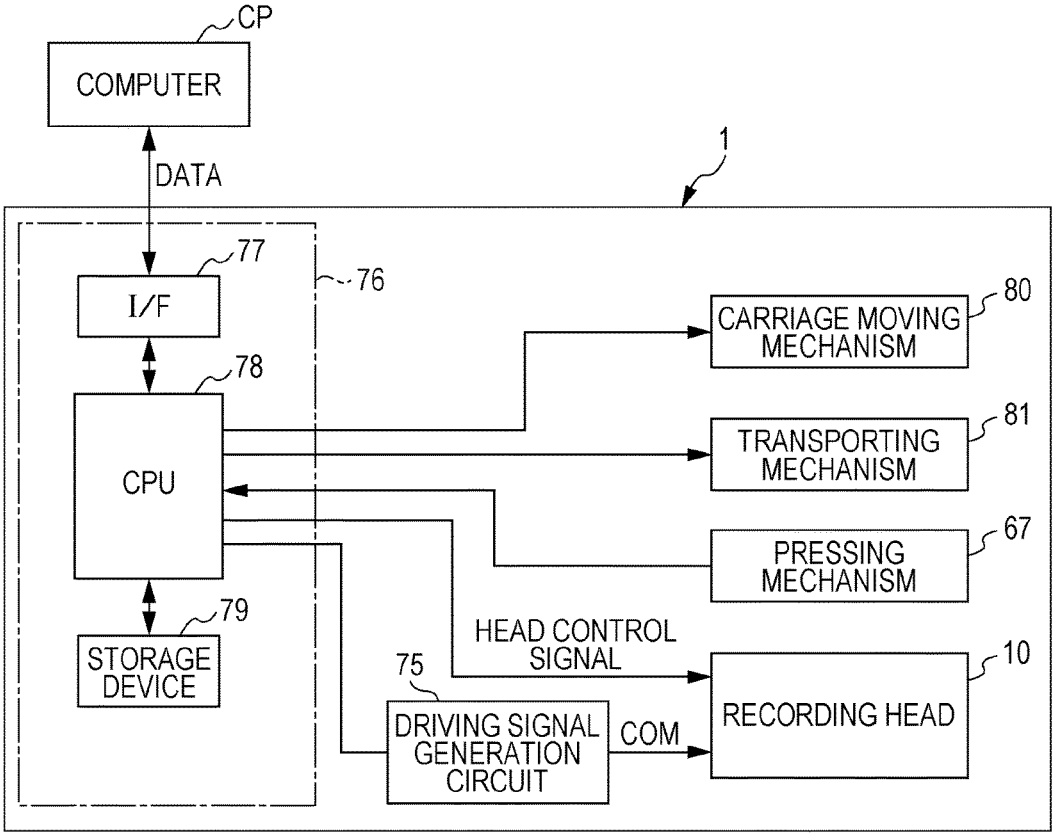
FIG. 7 is a block diagram illustrating an electrical configuration of the liquid ejecting apparatus.

FIG. 7 is a block diagram illustrating an electrical configuration of the printer 1.

A computer CP as an external device is connected to the printer 1 such that the computer CP can communicate with the printer 1. In order to cause the printer 1 to print an image, the computer CP transmits printing data according to the image to the printer 1. The printer 1 according to the embodiment includes a driving signal generation circuit 75, the recording head 10, the printer controller 76 (control circuit), the carriage moving mechanism 80 that causes the carriage 5 to reciprocate in a width direction (the main scanning direction) of the recording medium, the transporting mechanism 81 that transports the recording medium in the sub scanning direction intersecting with (orthogonal to) the main scanning direction, and the pressing mechanism 67. The driving signal generation circuit 75 generates a driving signal COM by generating amplifying an analog voltage signal on the basis of data related to the waveform of a driving signal sent from the printer controller 76. The driving signal COM is applied to the piezoelectric element 31 of the recording head 10 at the time of recording operation (liquid ejecting operation) of an image or the like with respect to the recording medium, and is a series of signals including at least one driving pulse within a unit period which is the repetition period of the driving signal COM. Here, the driving pulse is a pulse causing the piezoelectric element 31 to perform a predetermined operation such that ink droplets are ejected from the nozzle 30 of the recording head 10.

The printer controller 76 is a control unit controlling the printer. The printer controller 76 includes an interface unit (I/F) 77, a CPU 78, and a storage device 79. The interface unit 77 transmits and receives data between the computer CP or another external device and the printer 1. The CPU 78 is a computing device for controlling the entire printer. The storage device 79 is a device for securing an area for storing a program, a work area or the like in the CPU 78 and includes storage elements such as RAM, EEPROM, or the like. The CPU 78 controls each unit according to a program stored in the storage device 79.

Figure 8:
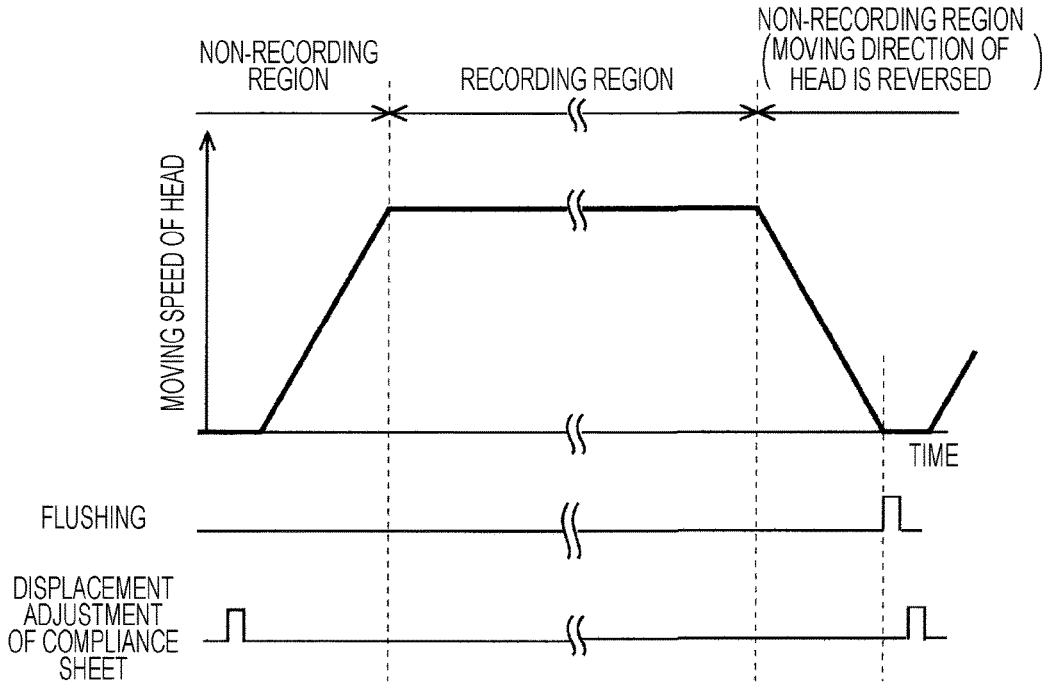
FIG. 8 is a timing chart illustrating a recording operation of the liquid ejecting apparatus.

FIG. 8 is a timing chart for illustrating the recording operation (liquid ejecting operation) performed by the recording head 10 which is controlled by the printer controller 76 of the printer 1. Note that, the timing of the displacement adjustment of the compliance sheet 44 and the timing of a flushing operation are represented by using rectangular pulses. In the printer 1 according to the embodiment, before the recording operation is performed by the recording head 10 with the printing data received, the pressure receiving member 62 is pressed by the pressing mechanism 67 of the pressure adjusting valve mechanism 21 as described above so that the displacement of the compliance sheet 44 is adjusted to the initial position. Specifically, as illustrated in FIGS. 3 and 4, the displacement of the compliance sheet 44 is adjusted such that the compliance sheet 44 becomes flat being substantially parallel to the opening surface of the reservoir 43 or the compliance sheet 44 is displaced (protrude) toward the outside, which is opposite to the reservoir 43, that is, toward the compliance space 47 side. In this manner, it is possible to secure a larger $\Delta V$. In other words, it is possible to secure a larger stroke amount of the compliance sheet 44 at the time of pressure change. At this time, the printer controller 76 controls the pressing mechanism 67 so as to increase the pressure in the reservoir 43 to the extent that the pressure in the reservoir 43 does not exceed the withstand pressure of the surface (meniscus) of ink in the nozzle 30 (the pressure at which the leakage of ink from the nozzle 30 can be prevented). In the embodiment, with the withstand pressure of the meniscus being 5 kPa, the pressure in the reservoir 43 is adjusted to become equal to or larger than 0 kPa and equal to or less than 1 kPa. Accordingly, it is possible to adjust the displacement of the compliance sheet 44 while suppressing problems, such as unexpected leakage of ink from the nozzle 30. In addition, at this time, it is desirable to adjust the displacement of the compliance sheet 44 to the extent that the compliance sheet 44 does not come into contact with the fixation plate 23 which defines a portion of the compliance space 47. This is because the compliance sheet 44 may adhere to the fixation plate 23 due to condensation on the fixation plate 23 or an increase in adhesiveness of the compliance sheet 44 and the displacement of the compliance sheet 44 may be hindered, depending on the ambient temperature.

When the recording operation is started, the recording head 10 standing by at the home position starts to move toward a position opposite to the home position with respect to the platen 3 in the main scanning direction. Acceleration until the moving speed of the recording head 10 becomes a predetermined speed is performed in the non-recording region (outside the recording region). In the recording region, that is, in a range corresponding to the recording region in which text, an image, or the like is actually recorded on the recording medium mounted on the platen 3, the recording head 10 moves at a constant speed and ink is ejected from the nozzle 30 with the driving pulses included in the driving signal COM being applied to the piezoelectric element 31 on the basis of the printing data. In this manner, an image or the like is recorded on the recording medium. When ink is consumed in the recording operation, the inner pressure of the reservoir 43 is gradually decreased, and in accordance with this, the compliance sheet 44 is displaced toward the inside of the reservoir 43 from the initial position after the above-described adjustment. In addition, when the recording head 10 moves to a region corresponding to the non-recording region on the outside of the recording region, a reversing operation of temporarily stopping the recording operation, decelerating the recording head 10, and reversing the movement direction of the recording head 10 is performed.

In the embodiment, the displacement adjustment of the compliance sheet 44 is performed while the movement direction of the recording head 10 is being reversed in the non-recording region. Accordingly, even in a case where the compliance sheet 44 is displaced from the initial position due to a decrease in pressure in the reservoir 43 which is caused by the recording head 10 ejecting ink, the compliance sheet 44 can be returned to the initial position. Therefore, variation in ejecting properties of each nozzle 30 in a series of recording operations is more reliably decreased. In addition, in the embodiment, in a case where the recording head 10 performs the flushing operation (an operation of ejecting ink not for recording) in the non-recording region, the displacement adjustment of the compliance sheet 44 is performed after the flushing operation is finished. That is, since the compliance sheet 44 is displaced toward the inside of the reservoir 43 when ink is ejected from the nozzle 30 due to the flushing operation, if the displacement adjustment of the compliance sheet 44 is performed after the flushing operation is finished, the recording operation can be restarted with the compliance sheet 44 being positioned in the initial position. Similarly, in a case where a cleaning operation of forcibly discharging ink or air bubbles from the nozzle 30 into the cap 12 by using the capping mechanism 11 is performed separately from the recording operation, if the displacement adjustment of the compliance sheet 44 is performed after the cleaning operation, the recording operation can be restarted with the compliance sheet 44 being positioned in the initial position. Note that, the displacement adjustment of the compliance sheet 44 may be performed each time the movement direction of the recording head 10 is reversed in the non-recording region and may be performed, for example, each time a predetermined number of passages (the unit of scanning operation of the recording head 10) are finished.

As described above, in the printer 1 according to the embodiment, since the displacement adjustment of the compliance sheet 44 is performed by the pressure adjusting valve mechanism 21, the compliance sheet 44 becomes flat being substantially parallel to the opening surface of the reservoir 43 or the compliance sheet 44 is displaced (bent) toward the outside, which is opposite to the reservoir 43, that is, toward the compliance space 47 side at least in the initial state immediately before the recording operation (liquid ejecting operation) is started. Therefore, it is possible to increase the displacement magnitude of the compliance sheet 44 in the recording region and it is possible to cope with a wider range of pressure change. In other words, by securing a larger $\Delta V$ with respect to the $\Delta P$, it is possible to increase the compliance amount C. As a result, variation in ejecting properties of ink ejected from the nozzle 30 is suppressed. Particularly, even in a case where a recording operation in which a larger amount of ink is ejected from a larger number of nozzles 30 is performed such as a case of so-called solid printing in which a predetermined range of the recording medium is fully filled with ink, the compliance sheet 44 can sufficiently cope with the pressure change. In addition, in the embodiment, since the displacement adjustment of the compliance sheet 44 is performed in the non-recording region, it is possible to prevent adverse effects on the recording operation which are caused by a fluctuation in pressure in the reservoir 43 accompanied by the displacement adjustment of the compliance sheet 44. Furthermore, in the embodiment, since the displacement adjustment of the compliance sheet 44 is performed by the pressure adjusting valve mechanism 21, it is sufficient to provide the simple pressing mechanism 67 that presses the pressure receiving member 62 and it is not necessary to separately provide a mechanism for adjusting the position of the compliance sheet 44. In addition, it is possible to more accurately adjust displacement of the compliance sheet 44 at an arbitrary time by opening the pressure adjusting valve 57 with the pressing mechanism 67 pressing the pressure receiving member 62. In addition, since it is not necessary to increase the compliance sheet 44 or to separately add a compliance member, it is possible to cope with miniaturization of the recording head 10 or the printer 1.

Regarding the displacement adjustment of the compliance sheet 44, the invention is not limited to an embodiment in which the displacement adjustment is performed in the non-recording region as described in the first embodiment. For example, the displacement adjustment of the compliance sheet 44 may be performed during the recording operation also. In this case, the displacement adjustment of the compliance sheet 44 may be performed at predetermined intervals, or a time at which the amount of ink consumed in the recording head 10 is sharply increased may be grasped and the displacement adjustment of the compliance sheet 44 may be performed before this time. In the latter case, for example, the printer controller 76 calculates the amount of ink consumed (the amount of ink scheduled to be ejected) per unit period for each nozzle row (for each kind of ink in a configuration in which a plurality kinds of ink is assigned to one nozzle row) in advance on the basis of the printing data, compares the calculated value and a predetermined threshold value, and performs the displacement adjustment of the compliance sheet 44 according to the corresponding nozzle row (the kind of ink) before the amount of ink consumed exceeds the threshold value. Therefore, the compliance sheet 44 can cope with even a sharp pressure change and the pressure change can be attenuated. As a result, variation in ejecting properties of each nozzle 30 communicating with the reservoir 43 is more reliably decreased. Furthermore, it is also possible to adjust the displacement of the compliance sheet 44 to be always close to the initial position by continuously driving the air pump 16 which is the pressurization mechanism and causing the pressure adjusting valve 57 to be always in the opened state by using the pressing mechanism 67 so as to adjust the openness of the pressure adjusting valve 57. Accordingly, the sharp pressure change can be more reliably attenuated.

In the first embodiment, as a configuration for supplying ink from the ink cartridge 13 to the recording head 10, a configuration, in which ink in the ink cartridge 13 is supplied to the recording head 10 side through the ink supply tube 17 due to pressurization performed by the air pump 16 which is a kind of a pressurization mechanism, has been described. However, the configuration is not limited to this. For example, instead of the air pump 16, a feeding pump such as a so-called squeezing pump (a tube pump) may be provided in the ink supply path (the ink supply tube 17) between the ink cartridge 13 and the recording head 10 as a pressurization mechanism and the ink in the ink cartridge 13 may be supplied to the recording head 10 side through the ink supply tube 17 by the feeding pump.

In addition, in a printer provided with a ink circulation system that includes a first ink path extending from the ink cartridge 13 to the recording head 10 side and a second ink path extending from the recording head 10 to the ink cartridge 13 side, ink can be supplied to the recording head 10 at a predetermined supply pressure at the time of a normal recording operation, and the ink can be supplied to the recording head 10 at a supply pressure higher than the supply pressure for the normal recording operation at the time of the cleaning operation of forcibly discharging ink from the nozzle 30. In this configuration, for example, in a state where the second ink path is closed by a valve, a pump as the pressurization mechanism which is provided in the first ink path is driven so that ink is pressure-fed to the recording head 10 from the ink cartridge and the pressure in the reservoir of the recording head is increased. In this manner, it is possible to perform the displacement adjustment of the compliance sheet.

Figure 9:
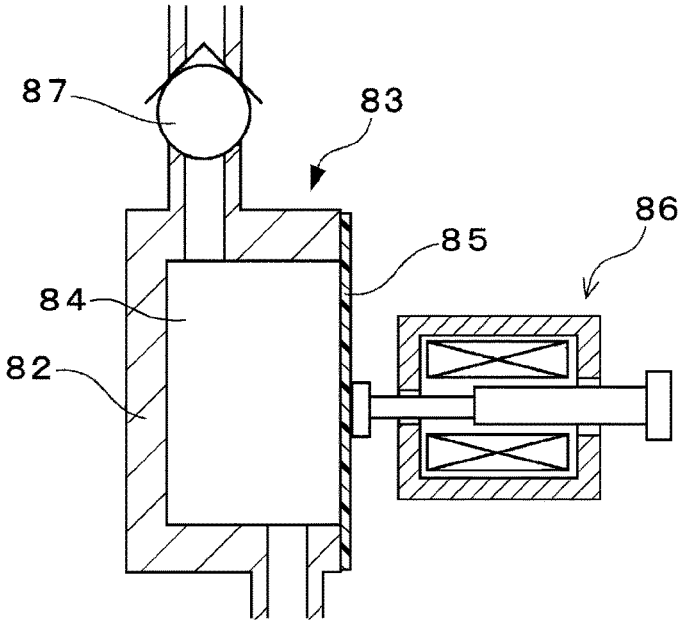
FIG. 9 is a view illustrating a configuration according to a second embodiment.

Furthermore, the example of the pressure adjusting mechanism is not limited to the pressure adjusting valve mechanism 21 in the above-described embodiment. FIG. 9 is a schematic view illustrating a configuration of a pressure adjusting mechanism according to a second embodiment of the invention. In the second embodiment, a buffer member 83 including a buffer space 84 which stores ink to be supplied to the recording head 10 from the ink cartridge 13 and a flexible buffer film 85 which seals and defines a portion of the buffer space 84 in a frame member 82 is disposed as the pressure adjusting mechanism in a supply path between the ink cartridge 13 and the reservoir 43 of the recording head 10. The buffer member 83 attenuates the ink pressure change in the supply path with the buffer film 85 being displaced according to the pressure change in the buffer space 84. The other configurations are the same as those in the first embodiment. In a portion of the buffer member 83 through which ink in the buffer space 84 is introduced, a check valve 87 which allows ink to flow into the buffer member 83 from the ink supply tube 17 side and prevents the ink to flow to the ink supply tube 17 side from the buffer member 83 is provided, and a pressing mechanism 86 having the same configuration as the pressing mechanism 67 is provided. In addition, in the buffer member 83, similar to the pressure adjusting valve mechanism 21, the displacement of the compliance sheet can be performed by pressing the buffer film 85 by using the pressing mechanism 86. In addition, the examples of the pressing mechanisms 67 and 87 are not limited to a pressing mechanism configured by using a push solenoid which is described above, and the pressing mechanisms 67 and 87 may have various configurations as long as the pressure receiving member 62 or the buffer film 85 can be pressed by the pressing mechanisms 67 and 87. For example, a pressing mechanism that presses the pressure receiving member 62 or the like by using pressurized air or the like may be adopted.

Figure 10:
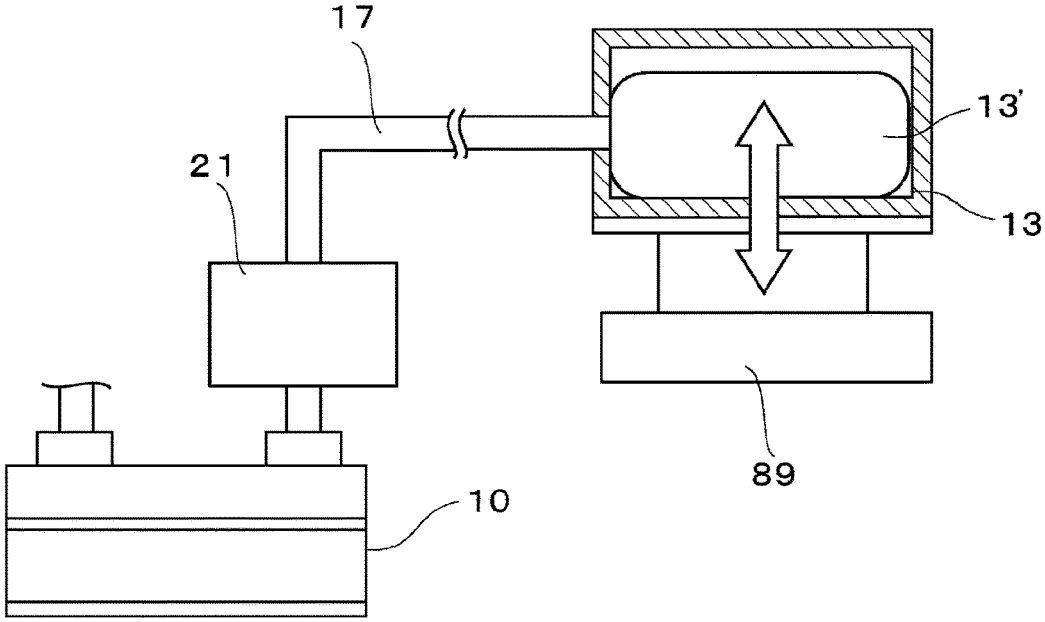
FIG. 10 is a view illustrating a configuration according to a third embodiment.

FIG. 10 is a schematic view illustrating a configuration of an ink supply path according to a third embodiment of the invention which extends from the ink cartridge 13 to the recording head 10 through the ink supply tube 17. In the third embodiment, a hydraulic head adjustment mechanism 89 that raises and lowers the ink cartridge 13 in the vertical direction is provided as a pressurization mechanism. That is, the hydraulic head adjustment mechanism 89 adjusts pressure acting on a meniscus in the nozzle 30 by raising and lowering the ink cartridge 13 to cause a difference in height between the ink cartridge 13 and the recording head 10. In the third embodiment, it is possible to perform the displacement adjustment of the compliance sheet by using a difference in hydraulic head between the ink cartridge 13 and the nozzle 30 of the recording head 10, which is caused by the hydraulic head adjustment mechanism 89. The other configurations are the same as those in the first embodiment.

Furthermore, the example of a method of adjusting the displacement of the compliance sheet 44 is not limited to a method of increasing (pressurizing) the pressure in the reservoir 43. For example, the displacement adjustment of the compliance sheet may be performed by decreasing the pressure in the compliance space 47.

Figure 11:
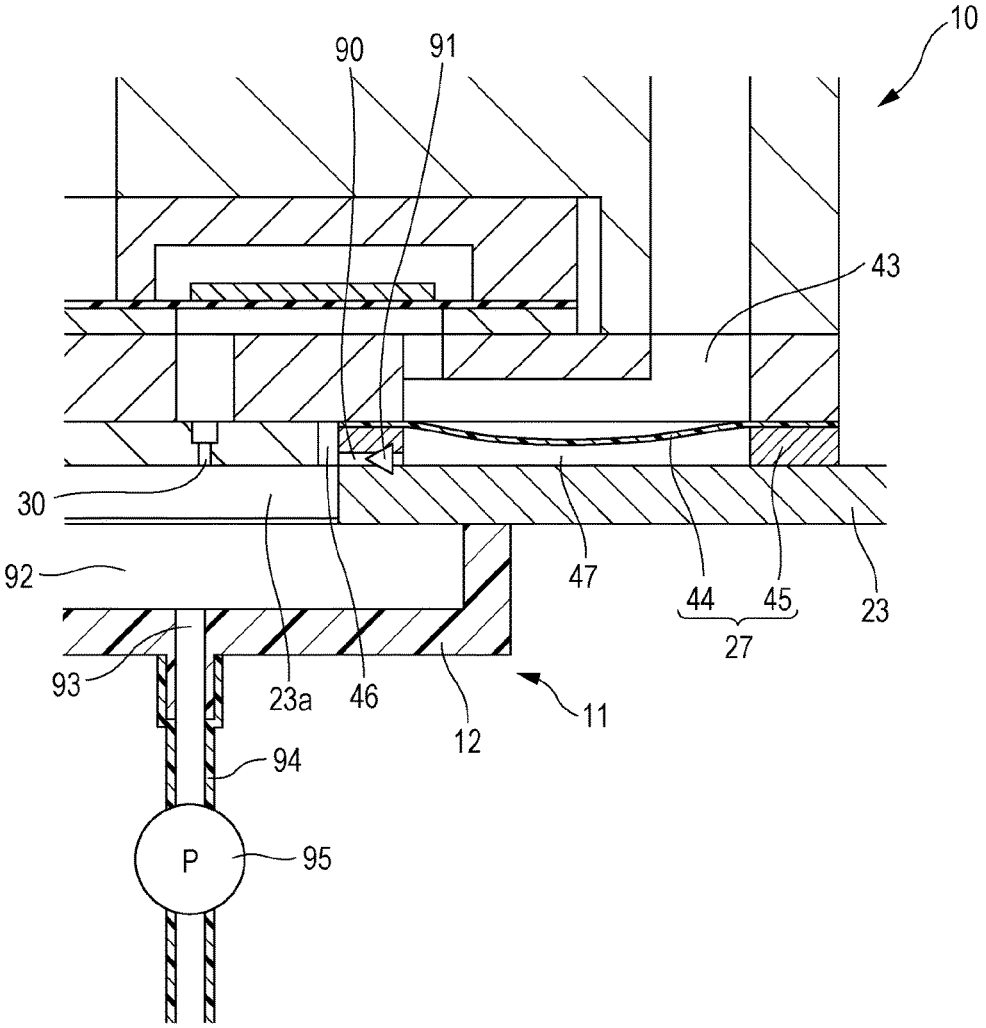
FIG. 11 is a view illustrating a configuration according to a fourth embodiment.

FIG. 11 is a sectional view illustrating a configuration around the compliance sheet 44 according to a fourth embodiment of the invention. In the fourth embodiment, on the supporting plate 45 of the compliance substrate 27, a pressure adjustment path 90 (a pressure adjustment path in the invention) which extends from the compliance space 47 to the through-opening 46 and the through-port 23*a* is formed. That is, the compliance space 47 communicates with the atmosphere through the pressure adjustment path 90 at an opening portion which is constituted by the through-opening 46 and the through-port 23*a*. In the middle of the pressure adjustment path 90, a check valve 91 is provided. The check valve 91 allows air to flow to the 46 side from the compliance space 47 side and prevents air from flowing to the compliance space 47 side from the through-opening 46 side.

In the fourth embodiment, the capping mechanism 11 for performing the cleaning operation which is a kind of a maintenance operation functions as the pressure adjusting mechanism in the invention also. The cap 12 of the capping mechanism 11 is a member made of elastic material such as elastomer and is formed into a tray-like shape in which an upper surface side opens. In a capping operation, the nozzle surface of the recording head 10 is sealed with the edge of an opening (an upper surface) of the cap 12 being in close contact with the fixation plate 23. The nozzle plate 24 faces a sealing hollow space 92 which is defined by the cap 12 and the nozzle surface of the recording head 10 in the sealed state though the opening portion of the nozzle surface of the recording head 10, that is, the through-port 23*a* of the fixation plate 23 and the through-opening 46 of the compliance substrate 27. Accordingly, the cap 12 seals the nozzle surface with the opening portion covered by the cap 12. In addition, in the sealed state, the pressure adjustment path 90 also communicates with the sealing hollow space 92 via the opening portion. On the bottom surface of the cap 12, a through-hole 93 is provided. The through-hole 93 is connected to the suction pump 95 via a liquid discharging tube 94. The suction pump 95 is configured of, for example, a tube pump or the like which feeds ink by squeezing the liquid discharging tube 94 by using a roller or the like, and discharges ink, air, or the like which is discharged into the cap 12 by achieving the negative pressure in the sealing hollow space 92. A discharge tank (not shown) is connected to the downstream side of the suction pump 95 and the ink, air, or the like fed by the suction pump 95 is discharged into the discharge tank. In addition, the internal space of the cap 12 communicates with the atmosphere via an atmosphere opening valve which is not shown.

In the fourth embodiment, at the time of the displacement adjustment of the compliance sheet 44, the carriage 5 moves to the home position and the nozzle surface of the recording head 10 is sealed by the cap 12 due to the capping mechanism 11. In addition, the suction pump 95 is operated in the sealed state and the pressure in the sealing hollow space 92 becomes negative. In this manner, the pressure in the compliance space 47 is decreased through the pressure adjustment path 90 and the compliance sheet 44 is displaced toward the outside, which is opposite to the reservoir 43, in accordance with the pressure change. At this time the pressure in the compliance space 47 is adjusted to be, for example, equal to or greater than −5 kPa and equal to or less than −1 kPa. If the pressure in the compliance space 47 is decreased and reaches a predetermined pressure, the atmosphere opening valve is open and the negative pressure in the cap 12 is released. At this time, since the check valve 91 is provided in the pressure adjustment path 90, a state in which the pressure in the compliance space 47 has been decreased is maintained. Thereafter, the cap 12 is lowered and the cap 12 is separated from the nozzle surface. According to this configuration, it is possible to adjust displacement of the compliance sheet 44 by using the capping mechanism 11 which performs the maintenance operation by sealing the nozzle surface by using the cap 12. Therefore, it is not necessary to separately provide a configuration for adjusting displacement of the compliance sheet 44. In addition, according to the configuration in the fourth embodiment, it is possible to adjust displacement of the compliance member at the same time as execution of the maintenance operation, and thus it is possible to reduce the turnaround time of the liquid ejecting apparatus which is the time taken from when the printer 1 receives an printing instruction to when the recording operation is finished. Furthermore, since the state in which the pressure in the compliance space 47 has been decreased is maintained by the check valve 91, the pressure change in the reservoir 43 during the recording operation can be attenuated for a longer time. Therefore, it is possible to decrease the frequency of displacement adjustment of the compliance sheet 44 and thus it is possible to reduce the turnaround time of the liquid ejecting apparatus in this point also.

Figure 12:
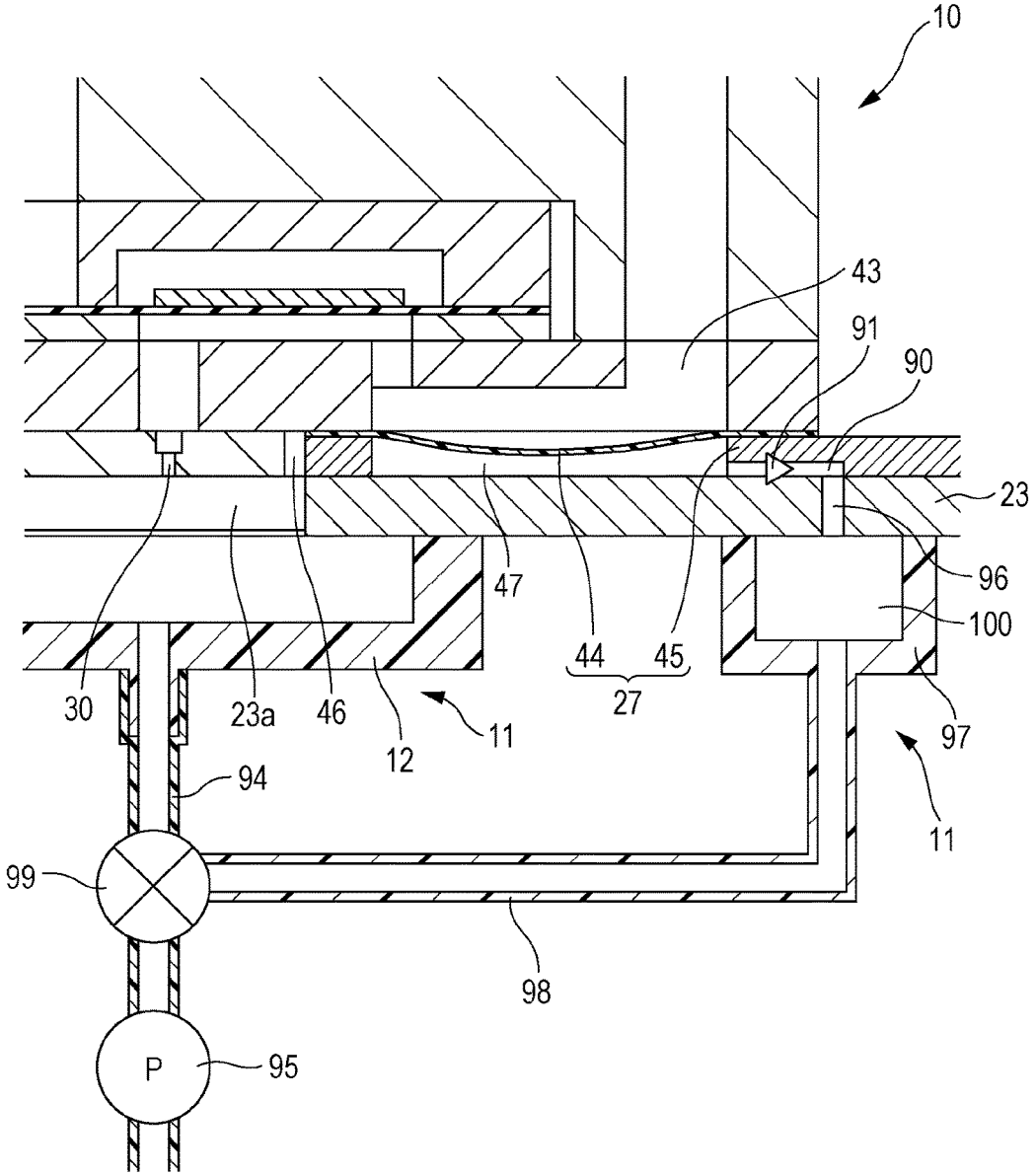
FIG. 12 is a view illustrating a configuration according to a fifth embodiment.

FIG. 12 is a sectional view illustrating a configuration around the compliance sheet 44 according to a fifth embodiment of the invention. In the fourth embodiment, a configuration in which the displacement adjustment of the compliance sheet 44 is performed by decreasing the pressure in the compliance space 47 by using the cap 12 which is used for the maintenance operation of the recording head 10 has been described. However, the invention is not limited to the above-described configuration. The fifth embodiment is different from the fourth embodiment in that displacement adjustment of the compliance sheet 44 is performed by decreasing the pressure in the compliance space 47 by using an adjustment cap 97 which is separately provided from the cap 12 for the cleaning operation. The pressure adjustment path 90 according to the fifth embodiment extends in the supporting plate 45 from the compliance space 47 toward a position opposite to the through-opening 46. An end portion of the pressure adjustment path 90 which is at a position opposite to the compliance space 47 communicates with a communication path 96 which is formed to penetrate the fixation plate 23 in the thickness direction of the fixation plate 23. The communication path 96 is provided at a position on the lower surface (the nozzle surface) of the fixation plate 23 which is separated from a region sealed by the cap 12. That is, the compliance space 47 is opened to the atmosphere through the pressure adjustment path 90 and the communication path 96. As with the third embodiment, the pressure adjustment path 90 in the fifth embodiment is also provided with the check valve 91 that allows air to flow to the outside from the compliance space 47 side and prevents air from flowing to the compliance space 47 side from the outside.

In the fifth embodiment, as with the cap 12, the adjustment cap 97 is a member made of elastic material such as elastomer and is formed into a tray-like shape in which an upper surface side opens. The size of the adjustment cap 97 is set such that the adjustment cap 97 can seal the opening of the communication path 96 provided on the nozzle surface. The opening of the communication path 96 faces a sealing hollow space 100 which is defined by the adjustment cap 97 and the nozzle surface (the fixation plate 23) of the recording head 10 in the sealed state due to the adjustment cap 97 and thus the communication path 96 communicates with the compliance space 47. An end of a depressurizing tube 98 is connected to the adjustment cap 97 and the other end of the depressurizing tube 98 is connected to the liquid discharging tube 94 of the capping mechanism 11 through a three-way valve 99.

In the fifth embodiment, at the time of the displacement adjustment of the compliance sheet 44, the three-way valve 99 allows the sealing hollow space 100 and the suction pump 95 to communicate with each other with a region on the nozzle surface, in which the communication path 96 is provided, being sealed by the adjustment cap 97. The suction pump 95 is operated in this state and the pressure in the sealing hollow space 100 becomes negative. In this manner, the pressure in the compliance space 47 is decreased through the pressure adjustment path 90 and the compliance sheet 44 is displaced toward the outside, which is opposite to the reservoir 43, that is, toward the compliance space 47 in accordance with the pressure change. As described above, in the fifth embodiment, it is possible to perform the displacement adjustment of the compliance sheet in the same manner as in the fourth embodiment. In addition, in the fifth embodiment, since the displacement adjustment of the compliance sheet is performed separately from the cleaning operation, it is easy to adjust the pressure of the compliance space 47 to an arbitrary value.

In addition, regarding a configuration in which the displacement adjustment of the compliance sheet is performed by decreasing the pressure in the compliance space 47, the configuration is not limited to those described in the fourth embodiment and the fifth embodiment as long as the pressure in the compliance space 47 can be decreased. For example, a suctioning mechanism such as a pump for depressurization may be separately provided from the suction pump 95 which is used for the cleaning operation of the recording head 10 and the displacement of the compliance sheet 44 may be adjusted by decreasing the pressure in the compliance space 47 by using the pump for depressurization always.

Furthermore, in the above-described embodiments, the so-called serial type printer 1 in which ink is ejected while relatively moving the recording head 10 in the width direction of the recording medium has been exemplified. However, the invention is not limited to this. For example, the invention can be applied to a so-called line-type printer also in which the entire length (in a configuration in which a plurality of recording heads are mounted, the sum of lengths of the nozzle rows of the recording heads) of a nozzle row, which is constituted by a plurality of nozzles arranged in a direction intersecting with a recording medium feeding direction, is set such that it is possible to cope with the width of the largest recording medium on which the printer can perform the recording and the recording operation is performed while transporting the recording medium without moving the recording head (a line type recording head) (without a scanning operation). In this case, for example, regarding the timing of the displacement of the compliance sheet, the displacement of the compliance sheet may be performed at a time in which the recording head faces the non-recording region (including a region on the recording medium on which the recording is not performed and a region outside the recording medium (in which the recording medium is not disposed)) of the recording medium, as in a period from when the recording operation on one recording medium is finished to when the next recording medium is fed onto the platen. That is, in a case where the recording medium is continuous paper such as roll paper, the displacement adjustment of the compliance sheet is performed at a time in which the recording head faces the non-recording region on the recording medium which is outside the recording region on which the image or the like is actually recorded. In addition, in a case where the recording medium is cut paper (a paper sheet), the displacement adjustment of the compliance sheet may be performed at a time in which the recording head faces the non-recording region on the recording medium which is outside the recording region on which the image or the like is actually recorded or at a time in which the recording head faces the non-recording region outside the recording medium (a region in which the recording medium is not disposed in a period from when one recording medium is discharged to when the next recording medium is fed). In this case, the displacement adjustment of the compliance sheet is performed each time the liquid ejecting head faces the non-recording region, and thus variation in ejecting properties of each nozzle in a series of recording operations is more reliably decreased.

In addition, in the line type printer, since the recording head does not move, it is easy to perform the displacement adjustment of the compliance sheet by using the pressure adjusting mechanism. For this reason, the invention is not limited to a configuration in which the displacement adjustment is performed in a case where the recording head faces the non-recording region, and for example, a configuration in which the pressure in the compliance space 47 is always decreased by using the adjustment cap 97 and the suction pump 95 as in the configuration according to the fifth embodiment may be adopted.

In addition, the above description has been made by using the ink jet recording head 10 (the recording head 10) which is a kind of a liquid ejecting head as an example. However, the invention can be applied to another liquid ejecting head including a compliance sheet (compliance member) and a liquid ejecting apparatus including the liquid ejecting head. For example, the invention can be applied to a liquid ejecting head including a plurality of coloring material ejecting heads for manufacturing a color filter of a liquid crystal display or the like, a plurality of electrode material ejecting heads for forming an electrode of an organic electro luminescence (EL) display, a field emission display (FED) or the like, a plurality of bio organic material ejecting heads for manufacturing a bio chip (a biochemical element) or the like and the liquid ejecting apparatus including the liquid ejecting head.

What is claimed is:

1. A liquid ejecting head comprising:

a pressure chamber that communicates with a nozzle which ejects liquid;

a liquid chamber that communicates with the pressure chamber;

a flexible compliance member that defines a portion of the liquid chamber; and a pressure adjusting mechanism that adjusts a supply pressure of liquid supplied to the liquid chamber, wherein the pressure adjusting mechanism can adjust displacement of the compliance member.

2. A liquid ejecting head comprising:

a pressure chamber that communicates with a nozzle which ejects liquid;

a liquid chamber that communicates with the pressure chamber; and a flexible compliance member that defines a portion of the liquid chamber, wherein a compliance space that allows displacement of the compliance member is provided at a position opposite to the liquid chamber with the compliance member interposed therebetween, and wherein a pressure adjusting mechanism that adjusts pressure in the compliance space is connected to the compliance space.

3. A liquid ejecting apparatus comprising:

a liquid ejecting head including a pressure chamber that communicates with a nozzle which ejects liquid, a liquid chamber that communicates with the pressure chamber, and a flexible compliance member that defines a portion of the liquid chamber; and a pressure adjusting mechanism that adjusts a supply pressure of liquid supplied to the liquid chamber, wherein the pressure adjusting mechanism can adjust displacement of the compliance member.

4. The liquid ejecting apparatus according to claim 3, wherein a liquid storage container that stores liquid is provided on an upstream side of the pressure adjusting mechanism in a liquid supply path, and wherein the liquid in the liquid storage container is sent to the liquid ejecting head side by pressure that is generated by a pressurization mechanism.

5. The liquid ejecting apparatus according to claim 4, wherein the pressurization mechanism is a pump.

6. The liquid ejecting apparatus according to claim 4, wherein the pressurization mechanism is a hydraulic head adjustment mechanism which adjusts the hydraulic head of a meniscus in the nozzle by adjusting relative positions of the liquid ejecting head and the liquid storage container in a vertical direction.

7. The liquid ejecting apparatus according to claim 3, wherein the pressure adjusting mechanism includes a valve that adjusts a supply pressure of liquid by opening and closing a liquid supply path, a storage hollow space that is provided on a downstream side of the valve and stores liquid, a flexible pressure receiving member that defines a portion of the storage hollow space, and a pressing mechanism that can open the valve by pressing the pressure receiving member toward the storage hollow space side.

8. A liquid ejecting apparatus comprising:

a pressure chamber that communicates with a nozzle which ejects liquid;

a liquid chamber that communicates with the pressure chamber; and a flexible compliance member that defines a portion of the liquid chamber, wherein a compliance space that allows displacement of the compliance member is provided at a position opposite to the liquid chamber with the compliance member interposed therebetween, and wherein a pressure adjusting mechanism that adjusts pressure in the compliance space is connected to the compliance space.

9. The liquid ejecting apparatus according to claim 8, wherein a pressure adjustment path is provided between the compliance space and the pressure adjusting mechanism, wherein the pressure adjustment path communicates with the atmosphere via an opening portion which is provided on a nozzle surface including the nozzle of a liquid ejecting head and through which the nozzle is exposed, and wherein the pressure adjusting mechanism is connected to the compliance space through the opening portion.

10. The liquid ejecting apparatus according to claim 9, wherein the pressure adjustment path includes a check valve that allows air to flow to the outside from the compliance space side and prevents air from flowing to the compliance space side from the outside.

11. The liquid ejecting apparatus according to claim 9, wherein the pressure adjusting mechanism is connected to a sealing member that can seal the nozzle surface with the opening portion being covered by the sealing member.

12. A control method for a liquid ejecting apparatus which includes a liquid ejecting head including a pressure chamber that communicates with a nozzle which ejects liquid, a liquid chamber that communicates with the pressure chamber, and a flexible compliance member that defines a portion of the liquid chamber, and a pressure adjusting mechanism that adjusts a supply pressure of liquid supplied to the liquid chamber, the control method comprising:

performing displacement adjustment of the compliance member by using the pressure adjusting mechanism in a non-recording region of a recording medium which is on the outside of a recording region in which recording is performed.

13. The control method for a liquid ejecting apparatus according to claim 12, wherein the displacement adjustment of the compliance member is performed while a movement direction of the liquid ejecting head is being reversed in the non-recording region during a recording operation in which liquid is ejected from the nozzle with the liquid ejecting head being moved relative to the recording medium.

14. The control method for a liquid ejecting apparatus according to claim 12, wherein the displacement adjustment of the compliance member is performed while the nozzle of a line type liquid ejecting head is facing the non-recording region.

15. A control method for a liquid ejecting apparatus which includes a liquid ejecting head including a pressure chamber that communicates with a nozzle which ejects liquid, a liquid chamber that communicates with the pressure chamber, and a flexible compliance member that defines a portion of the liquid chamber, a pressure adjusting mechanism that adjusts a supply pressure of liquid supplied to the liquid chamber, and a compliance space that is provided at a position opposite to the liquid chamber with the compliance member interposed therebetween and in which a pressure adjustment path that is provided between the compliance space and the pressure adjusting mechanism communicates with the atmosphere via an opening portion which is provided on a nozzle surface including the nozzle of the liquid ejecting head and through which the nozzle is exposed, and the pressure adjusting mechanism is a suctioning mechanism that suctions liquid from the nozzle through a sealing member that seals the nozzle surface, the control method comprising:

adjusting displacement of the compliance member by sealing the nozzle surface by using the sealing member with the opening portion being covered by the sealing member and suctioning liquid by using the suctioning mechanism.

16. A control method for a liquid ejecting apparatus which includes a liquid ejecting head including a pressure chamber that communicates with a nozzle which ejects liquid, a liquid chamber that communicates with the pressure chamber, and a flexible compliance member that defines a portion of the liquid chamber, and a pressure adjusting mechanism that adjusts a supply pressure of liquid supplied to the liquid chamber, the control method comprising:

causing the pressure adjusting mechanism to adjust displacement of the compliance member according to the amount of liquid scheduled to be ejected in a recording operation in which liquid is ejected from the nozzle with respect to a recording medium.

* * * * *